US009506685B2

(12) United States Patent
Park et al.

(10) Patent No.: US 9,506,685 B2
(45) Date of Patent: Nov. 29, 2016

(54) REFRIGERATOR

(71) Applicant: LG Electronics Inc., Seoul (KR)

(72) Inventors: Hyungkyu Park, Changwon-si (KR); Youngun Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 61 days.

(21) Appl. No.: 13/862,982

(22) Filed: Apr. 15, 2013

(65) Prior Publication Data

US 2013/0270990 A1 Oct. 17, 2013

(30) Foreign Application Priority Data

Apr. 16, 2012 (KR) ..... 10-2012-0039387
Apr. 26, 2012 (KR) ..... 10-2012-0044021

(51) Int. Cl.
*A47B 96/04* (2006.01)
*F25D 23/02* (2006.01)
*F25D 23/00* (2006.01)

(52) U.S. Cl.
CPC ..... *F25D 23/028* (2013.01); *F25D 23/00* (2013.01)

(58) Field of Classification Search
CPC ..... F25D 23/028; F25D 23/00
USPC ..... 312/401, 402, 404, 405
See application file for complete search history.

(56) References Cited

U.S. PATENT DOCUMENTS 2,659,115 A * 11/1953 Anderson et al. ..... 49/277
5,908,228 A * 6/1999 Lee ..... 312/405
5,915,805 A * 6/1999 Lee ..... 312/405
6,655,765 B2 * 12/2003 Kawamura et al. ..... 312/405
8,025,349 B2 * 9/2011 Lim et al. ..... 312/405
2011/0050066 A1 * 3/2011 Lee et al. ..... 312/404
2011/0132024 A1 6/2011 Lim et al.
2011/0241512 A1 * 10/2011 Jung et al. ..... 312/405
2011/0273070 A1 * 11/2011 Shin et al. ..... 312/405
2011/0297686 A1 12/2011 Lim et al.

FOREIGN PATENT DOCUMENTS

CN 101892770 A 11/2010
CN 102003862 A 4/2011
CN 102087068 6/2011
CN 102235790 A 11/2011
EP 1 426 537 A2 6/2004
JP 2005195297 A 7/2005

* cited by examiner

*Primary Examiner* — Daniel J Troy
*Assistant Examiner* — Timothy M Ayres
(74) *Attorney, Agent, or Firm* — Dentons US LLP

(57) ABSTRACT

A refrigerator that includes a compartment to store foods, and a door to open and close the compartment. The door has a door main body, a door handle movably disposed on the door main body to actuate the door main body to be easily opened, a slider protruding toward the refrigerator main body in response to movement of the door handle, and a driving force transfer unit. The driving force transfer unit may be located between the door handle and slider to transfer a driving force, generated upon pulling the door handle, to the slider. The door further includes a pocket housing partially buried into the door main body and receiving therein the door handle. The slider and the driving force transfer unit may be individually detachable. This configuration facilitates opening of the refrigerator and inspection and replacement of components of the driving force transfer unit.

22 Claims, 20 Drawing Sheets

REFRIGERATOR

CROSS-REFERENCE TO RELATED APPLICATIONS

This application claims priority to Korean Patent Application Nos. 10-2012-0039387 and 10-2012-0044021, filed on Apr. 16 and Apr. 26, 2012 respectively, in the Korean Intellectual Property Office, which are hereby incorporated by reference as if fully set forth herein.

BACKGROUND

Field

The present disclosure relates to refrigerators. More specifically, the present disclosure relates to a refrigerator with a refrigerator door that facilitates opening of the refrigerator as well as inspection and replacement of components, while preserving aesthetics.

Discussion of the Related Art

Generally described, a refrigerator is an appliance that maintains foodstuffs in a refrigerated or frozen state to enable the foodstuffs to remain fresher for an extended period of time. Typically, the main body of the refrigerator has at least one cooling chamber for refrigerating or freezing food, in other words, a refrigeration chamber and a freezing chamber. The refrigerator main body may be provided with a refrigeration cycle system for supplying cold air into the cooling chamber.

The main body of the refrigerator usually has a door for opening and closing the cooling chamber. The door may be rotatably mounted onto a front surface of the cooling chamber. Alternatively, the door may be implemented as a drawer, which is slideable along back and forth directions of the cooling chamber. This drawer type of door may be implemented as a freezing chamber door for opening and closing a freezer.

FIGS. 1-3 illustrate the related art. FIG. 1 is a view showing one exemplary embodiment of a refrigerator door according to the related art, and FIG. 2 is a disassembled perspective view showing a sliding area on one side of FIG. 1. As shown in FIG. 1, a refrigerator may include a refrigerator main body 10 having a cooling chamber 20, and a door 25 for opening and closing the cooling chamber 20. The cooling chamber 20 may include a freezing chamber 21 and a refrigerating chamber 22. A refrigerating chamber door 26 may be mounted onto a front surface of the refrigerating chamber 22, and a freezing chamber door 31 may be mounted onto the freezing chamber 21.

The freezing chamber door 31 may be implemented as a drawer type door which is slideable back and forth. The freezing chamber door 31 may include a door main body 33, and a handle 25 disposed on a front surface of the door main body 33. The handle 35 may be rotatable away from the door main body 33.

A slider 37 may be disposed on an upper area of an inner surface of the door main body 33. The slider 37 may protrude to the rear of the door main body 33 when the handle 35 is pulled to open the freezing chamber 21. The slider 37 protruded from the door main body 33 may contact an edge of an opening of the cooling chamber 20, namely, the freezing chamber 21, so as to press the door main body 33 to be separated from the cooling chamber 20. This may facilitate for opening of the door main body 33.

The slider 37, as shown in FIG. 2, may include a sliding part 38 which is horizontally disposed and slideable, and a body part 39 for supporting the sliding part 38. The slider 37 may also include a spring 40 for restoring the sliding part 38 and the body part 39 to their initial positions. A linker 60 for transferring a driving force, applied upon pulling the handle 35, to the slider 37 may be placed in the door main body 33. The linker 60 may include a body 61, and a first linker axis 63 and a second linker axis 64 for rotatably supporting the body 61.

When the linker 60 is rotated by the handle 35, a head part 62 of the body 61 may press the body part 39 of the slider 37. Accordingly, the slider 37 may protrude from the door main body 33 toward the refrigerator main body 10. A lever 70 for transferring the movement of the handle 35 to the linker 60 may be located between the handle 35 and the linker 60. The lever 70 may include a body part 71, and a first lever axis 73 and a second lever axis 74 for rotatably supporting the body part 71. The lever 70 may be provided with a handle coupling part 75 to which the handle 35 is coupled. A housing 50 may be disposed in the door main body 33 so as to receive therein the linker 60, the slider 37, the spring 40, the lever 70 and the handle 35.

The housing 50 may be provided in plurality, which are coupled onto each other in a facing manner. The housing 50 may include an inner housing 53 located in a central portion of the door main body 33, and an outer housing 51 coupled to both sides of the inner housing 53, respectively. A first receiving part 54 for receiving therein the slider 37, the spring 40 and the linker 60 and a second receiving part 55 for receiving the handle 35 may be disposed within the inner housing 53 and the outer housings 51.

A first linker axis supporting part 56 and a second linker axis supporting part 57 for receiving and supporting the first linker axis 63 and the second linker axis 64 of the linker 60, respectively, may be formed in the outer housings 51 and the inner housing 53. Also, a first lever axis supporting part 58 and a second lever axis supporting part 59 for receiving and supporting the first lever axis 73 and the second lever axis 74, respectively, may be formed in the outer housing 51 and the inner housing 53.

However, in the related art refrigerator door, the outer housing 51 and the inner housing 53 may be inserted between an outer case and an inner case of the door main body 33 prior to placing foam on the door main body 33 and surrounded by a foaming agent upon foaming the door main body 33. This may make it difficult to detach the outer housing 51 and the inner housing 53. Accordingly, with the difficulty of detaching the slider 37, the linker 60 and the lever 70, which are coupled in the outer housing 51 and the inner housing 53 surrounded by the foaming agent, repair and/or replacement of such components may be unable upon an occurrence of disorder. Consequently, the refrigerator door should be replaced. Regarding the problem, a refrigerator door capable of inspecting and repairing a driving force transfer unit during usage has been introduced.

FIG. 3 is a view showing another example of a refrigerator door according to the related art. As shown in FIG. 3, a door 40 for a refrigerator may include a door main body 41, a handle 45 rotatable disposed on a front surface of the door main body 41, sliders 47 backwardly extendible from an upper area of an inner surface of the door main body 41, a driving force transfer unit (not shown) disposed in the door main body 41 for transferring a driving force, applied to the handle 45, to the slider 47.

A receiving part 42 in which the driving force transfer unit is received may be disposed on an upper area of the door main body 41. The receiving part 42, for example, may have an opening at an upper end of the door main body 41. A cover 44 for opening and closing the receiving part 42 may be disposed on the opening of the receiving part 42.

However, in the related art refrigerator door, forming a receiving part 42 having the opening on the upper end of the door main body 41 and placing the cover 44 for opening and closing the receiving part 41 in order to inspect the driving force transfer unit, can give rise to unsanitary conditions in the edge areas of the receiving part 42 and/or the cover 44. As a result, the refrigerator may be easily contaminated by foreign materials and the like, and have a diminished appearance. Consequently, the edge areas may lead to lower overall quality of the appearance of the refrigerator.

SUMMARY

Unfortunately, conventional refrigerator doors have the foregoing as well as other shortcomings. Difficulties in opening a door may be attributed to the heavy weight of a door, the weight of foods stored on the door, and lowered pressure from air shrinkage, etc. For example, due to the relatively low internal temperature of a freezing chamber, a stronger force must be applied by a user to open the freezing chamber door. This may be due to the low air pressure resulting from air shrinkage. The previously described drawer type of door may be particularly burdensome to open when used in conjunction with a freezing chamber in a large-sized refrigerator application.

Accordingly, a refrigerator door having a pusher, which may be extendible and retractable in cooperation with a handle of the door, is provided. With the disclosed refrigerator and door configuration, when the handle is pulled to open the door the pusher is extended. Thus, opening of the refrigerator door is facilitated. In addition, inspection and replacement of components of the refrigerator is also simplified. The disclosed refrigerator and door maintains the aesthetics of the refrigeration appliance. In other words, the disclosed refrigerator and door does not disturb, alter, or ruin the appearance of the refrigerator.

In an embodiment, a refrigerator is disclosed. The refrigerator may include a refrigerator main body having a compartment to store foods, and a door to open and close the compartment, wherein the door may include a door main body, a door handle movably disposed on the door main body to actuate the door main body to be easily open, and a slider protruding toward the refrigerator main body in response to movement of the door handle. The refrigerator door may also include a driving force transfer unit located between the door handle and the slider to transfer a driving force, generated upon pulling the door handle, to the slider, and a pocket housing partially buried into the door main body and receiving therein the door handle, the slider and the driving force transfer unit to be individually detachable.

The driving force transfer unit may include a case detachably received in the pocket housing and having a cavity with inner walls, and a linker located inside the cavity, the linker having a body part and a first linker axis and a second linker axis to rotatably support the body part. The body part may include one end portion connected to the door handle, and a head part movable in an opposite direction to the one end portion when the linker revolves.

The head part of the linker may include a first coupling part which is slideable, and the slider may include a second coupling part detachably coupled to the first coupling part, and an elastic part to allow the slider to be back into an initial position in the door. The case may include a first linker axis supporting part formed on a first side wall of the cavity to support the first linker axis, a second linker axis supporting part formed on a second side wall of the cavity to support the second linker shaft, and a guide way to guide the first coupling part of the head part of the linker to be movable horizontally.

The second coupling part of the slider may be loosely and detachably coupled to the first coupling part in order to allow somewhat slipped movements with a mechanical tolerance between them and being separate from each other. The slider may be attachable and detachable individually from the driving force transfer unit. The driving force transfer unit may further include a lever located between the linker and the handle so as to move the linker in response to the rotation of the handle.

A supporting protrusion may be placed within the pocket housing to support the case not to be detached, and a contact protrusion contactable with the supporting protrusion may be placed in the case. The supporting protrusion and the contact protrusion may be provided in plurality, respectively, and the plurality of supporting protrusion and the plurality of contact protrusions may be disposed with a gap such that a different protrusion is inserted through the gap. The pocket housing may include a single receiving part communicating with the outside.

As another exemplary embodiment, the driving force transfer unit may include a linker having a linker body part and a first linker axis and a second linker axis to rotatably support the linker body part, a first linker axis supporting part located in the pocket housing to support the first linker axis, and a second linker axis supporter detachably coupled to the pocket housing to support the second linker axis. The pocket housing may include a receiving part exposed to outside of an outer case of the door and configured to receive therein at least one area of the door handle, the linker and the slider to be detachable to the outside, and a sliding guide part located between the outer case and the inner case of the door.

The slider may include a sliding part slideable horizontally, a slider body part to support the sliding part, and an elastic part to allow the slider body part to come in contact with the head part of the linker. The sliding part may be located within the sliding guide part of the pocket housing. The second linker axis supporter may include a body part. The body part may include a fastening part to fix the second linker axis supporter to the pocket housing and selectively release the fixed second linker axis supporter from the pocket housing, and a second linker axis supporting part to receive and support the second linker axis.

The pocket housing may include a rotation preventing part coming in contact with an outer side of the second linker axis supporter to prevent rotation of the second linker axis supporter. The rotation preventing part may include a lower supporting part protruding from the pocket housing to come in contact with a lower portion of the second linker axis supporter, or a side supporting part protruding from the pocket housing to come in contact with a side portion thereof. The rotation preventing part may include a rib protruding from the pocket housing to be inserted into the second linker axis supporter, and a rib slit formed on the second linker axis supporter such that the rib is inserted therein. The fastening part may be formed through the body part such that the coupling member coupled to the pocket housing through the body part is inserted therethrough.

In accordance with another exemplary embodiment, there is provided a refrigerator including a refrigerator main body having a compartment to store foods, and a door to open and close the compartment, wherein the door may include a door main body, a door handle movably disposed on the door main body to actuate the door main body to be easily open, a pocket housing receiving at least one area of the door handle, the pocket housing being partially buried into the door, a case detachably coupled to the pocket housing and having a cavity with a plurality of inner walls, and a linker located within the cavity of the case.

The linker may include a body part having one end portion connected to the door handle and a head part movably provided or movable and opposite to the one end portion upon rotation of the linker, and a first linker axis and a second linker axis to rotatably support the body part, and a slider protruding toward the refrigerator main body in response to movement of the door handle. The case may include a first linker axis supporting part formed on a first side wall of the cavity to support the first linker axis, and a second linker axis supporting part formed on a second side wall of the cavity to support the second linker shaft.

In accordance with another exemplary embodiment, there is provided a refrigerator including a refrigerator main body having a compartment to store foods, and a door to open and close the compartment. The door may include a door main body, a door handle movably disposed on the door main body to actuate the door main body to be easily open, a linker provided with a body part having one end portion connected to the door handle and a head part movable opposite to the one end portion upon rotation of the linker, and a first linker axis and a second linker axis to rotatably support the body part, a slider slideable in response to movement of the door handle, the slider comprising a sliding part slideable horizontally, and a body part to support the sliding part, and an elastic part allowing the body part to come in contact with the head part of the linker.

In addition, A pocket housing may be provided with a receiving part exposed to outside of an outer case of the door main body so as to receive and install therein at least one area of the door handle, the linker and the slider, and a sliding guide part located between the outer case and an inner case of the door main body. The pocket housing may include a first linker axis supporting part formed in the pocket housing to support the first linker axis, and a second linker axis supporter detachably fixed to the pocket housing to face the first linker axis supporting part, the second linker axis supporting part supporting the second linker axis.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE ILLUSTRATED EMBODIMENTS

Figure 1:
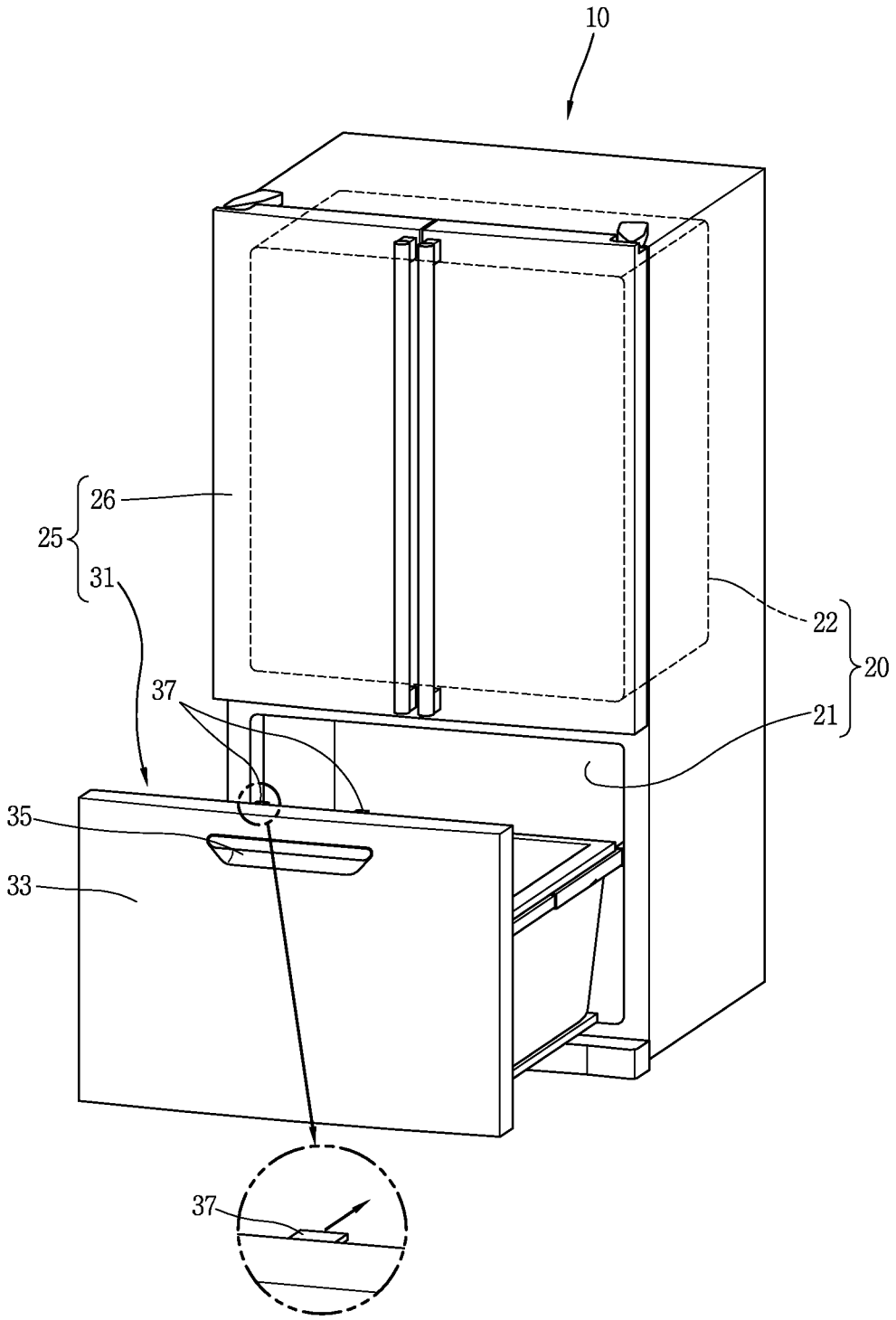
FIG. 1 RELATED ART
FIG. 1 is a view showing one example of a door for a refrigerator, according to the related art.
Figure 2:
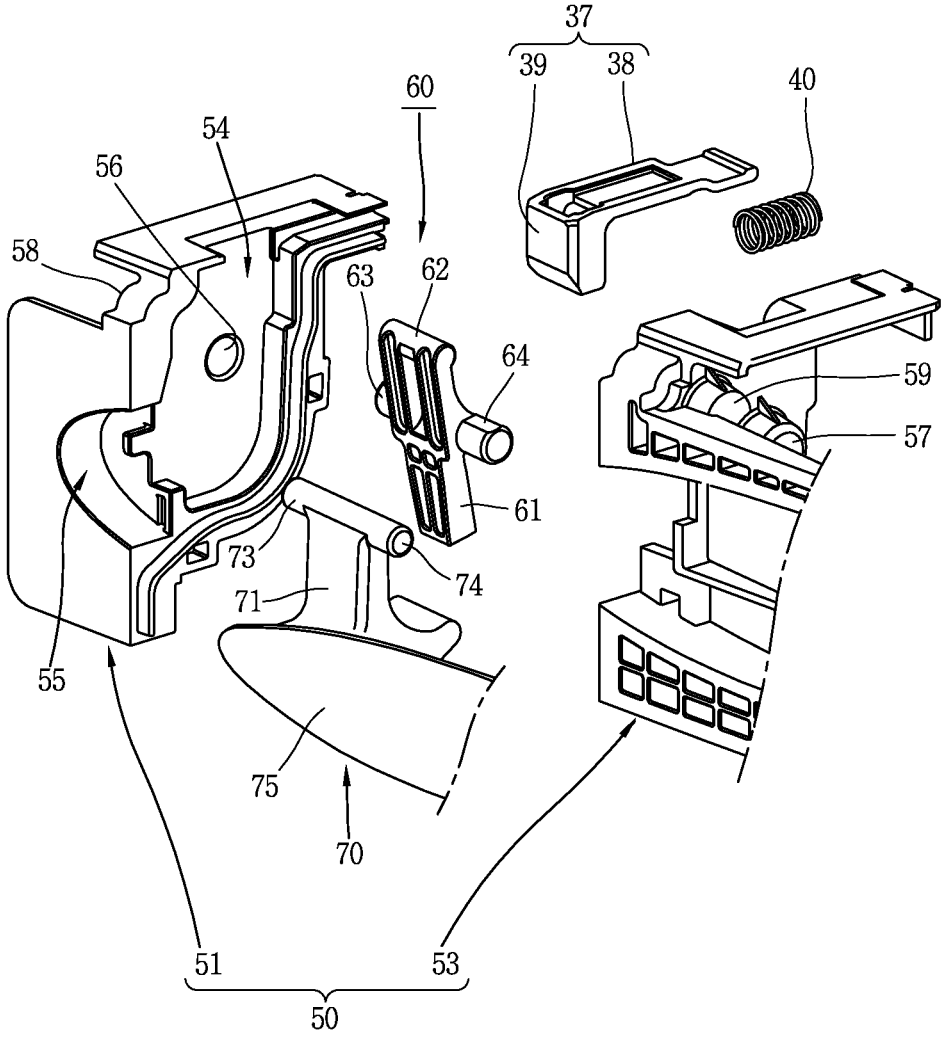
FIG. 2 RELATED ART
FIG. 2 is a disassembled perspective view of a slider area on one side of FIG. 1, according to the related art.
Figure 3:
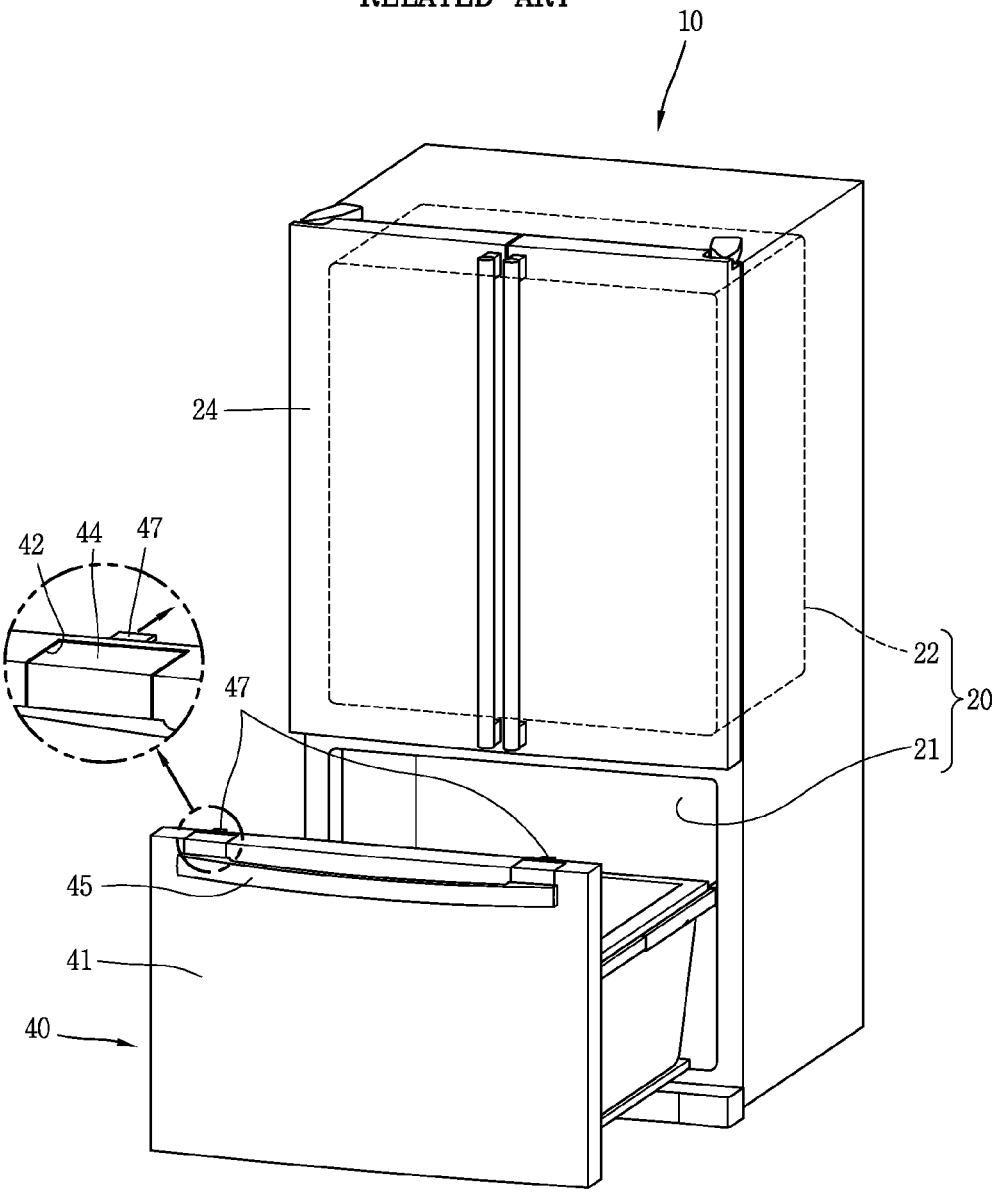
FIG. 3 RELATED ART
FIG. 3 is a view showing another example of a door for a refrigerator, according to the related art.
Figure 4:
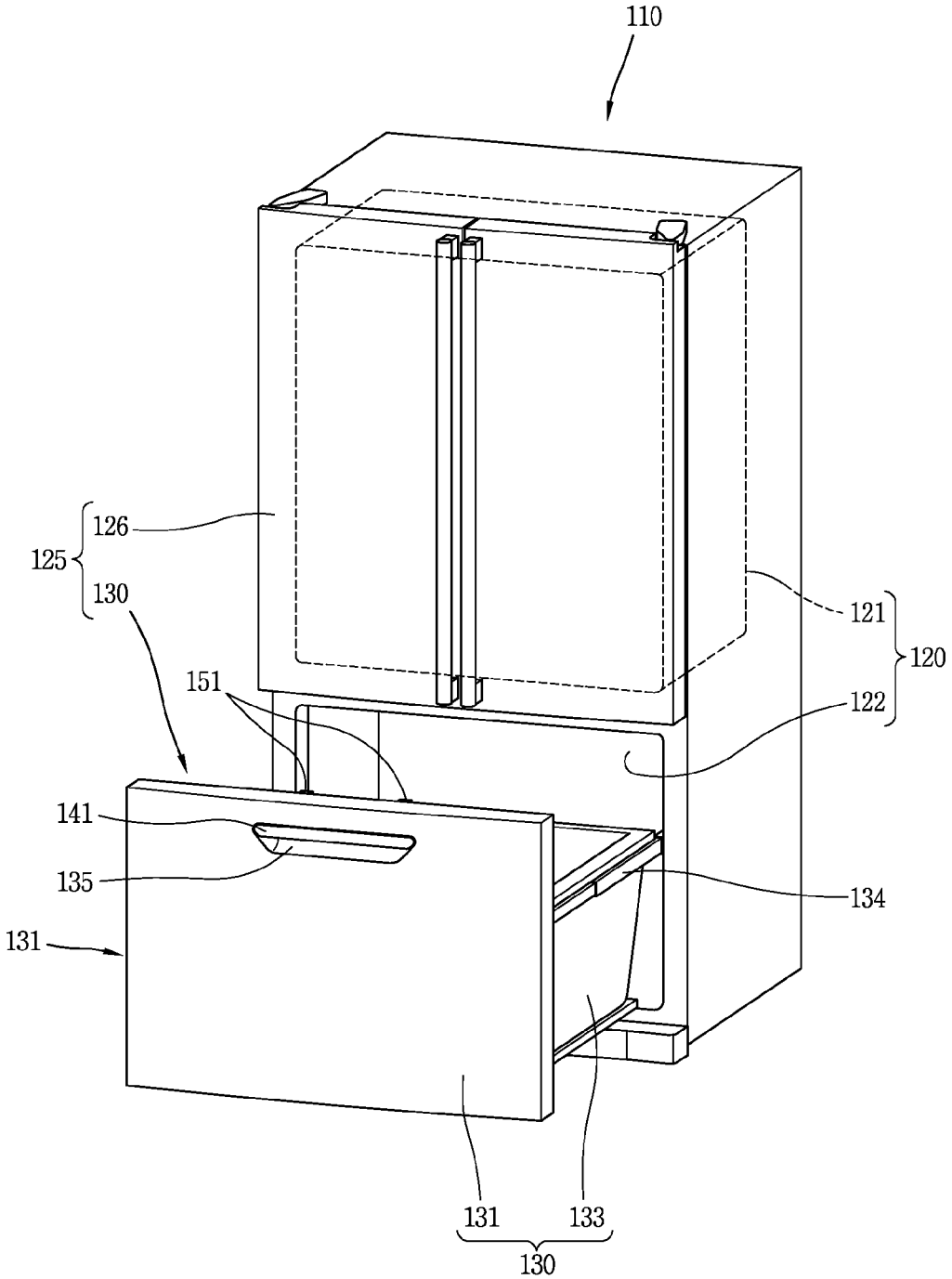
FIG. 4 is a perspective view of a refrigerator in accordance with one exemplary embodiment.

Description will now be given in detail of the exemplary embodiments, with reference to the accompanying drawings. For the sake of brief description with reference to the drawings, the same or equivalent components will be provided with the same reference numbers, and description thereof will not be repeated.

As shown in FIGS. 4 to 8, a refrigerator may include a refrigerator main body 110 having a plurality of compartments 120, and a door 125 for opening and closing front openings of the compartments 120. The refrigerator main body 110, as well known, may be provided with a refrigerating cycle system (not shown) for supplying cold air into the compartments 120. The refrigerating cycle system, for example, may be implemented as a vapor compression type refrigerating cycle system.

The refrigerator main body 110, for example, may include a refrigerating chamber 121 in its upper region, and a freezing chamber 122 in its lower region. The door 125 may include a door 126 for opening and closing the compartments 120 in a rotating manner, and a door 130 for opening and closing the compartments 120 in a sliding manner. The door 130 for the refrigerator according to the one exemplary embodiment may be provided on a front surface of the refrigerator main body 110.

The door 130 for the refrigerator in accordance with the one exemplary embodiment may include a door main body 131, a door handle 141 movably placed on the door main body 131 to facilitate for opening of the door main body 131, at least one slider 151 extending (protruding) toward the refrigerator main body in response to movement of the door handle 141, at least one driving force transfer unit 190 located between the door handle 141 and the slider 151 to transfer a driving force, generated when the door handle 141 is pulled, to the slider 151, and a pocket housing 170 partially buried in the door main body 131 to receive therein the door handle 141, the slider 151 and the driving force transfer unit 190 such that they are detachable individually.

The driving force transfer unit 190 may include a case 210 detachably received in the pocket housing 170 and having a cavity 212 with inner walls 217*a* and 217*b*, and a linker 230 having a body part 234 located in the cavity 212, a first linker axis 232*a* and a second linker axis 232*b* supporting the body part 234 to be rotatable. The body part 234 may include one end portion connected to the door handle 141, and a head part 236 moving in an opposite direction to the one end portion when the linker 230 is rotated.

The door 130 for the refrigerator according to the one exemplary embodiment may be configured to open and close the refrigerating chamber and/or the freezing chamber. Hereinafter, description will be given of an exemplary embodiment that the door 130 for the refrigerator is implemented as a drawer type freezing chamber door 130 for opening and closing the freezing chamber 122 in a sliding manner.

A refrigerating chamber door 126 for opening and closing the refrigerating chamber 121 in a rotating manner may be disposed on the front surface of the refrigerating chamber 121. The door 130 for the refrigerator (i.e., the freezing chamber door) may include a door main body 131 disposed on the front surface of the freezing chamber 122 to block (close) a front opening of the freezing chamber 122, and a food storage part 133 disposed on the rear of the door main body 131 to store foodstuffs.

Rails 134 for slideably supporting the freezing chamber door 130 may be disposed on side walls of the food storage part 133 and the freezing chamber 122. The door handle 141 may be disposed on the front surface of the door main body 131. The door handle 141, for example, may be disposed in right and left directions of the door main body 131.

The door handle 141 may be rotatable with respect to the door main body 131. A handle coupling part 135 to which the door handle 141 is rotatably coupled may be formed on the front surface of the door main body 131. The slider 151 may be placed on a rear area of the door main body 131. The slider 151 may extend (protrude) to the rear of the door main body 131, cooperative with the door handle 141, when the door handle 141 is pulled. Accordingly, when the door handle 141 is rotated by being pulled forward, the slider 151 may protrude to the rear of the door main body 131 to contact and press an edge portion of the front opening of the freezing chamber 122 of the refrigerator main body 110, thereby facilitating the door main body 131 to be drawn forward.

Figure 5:
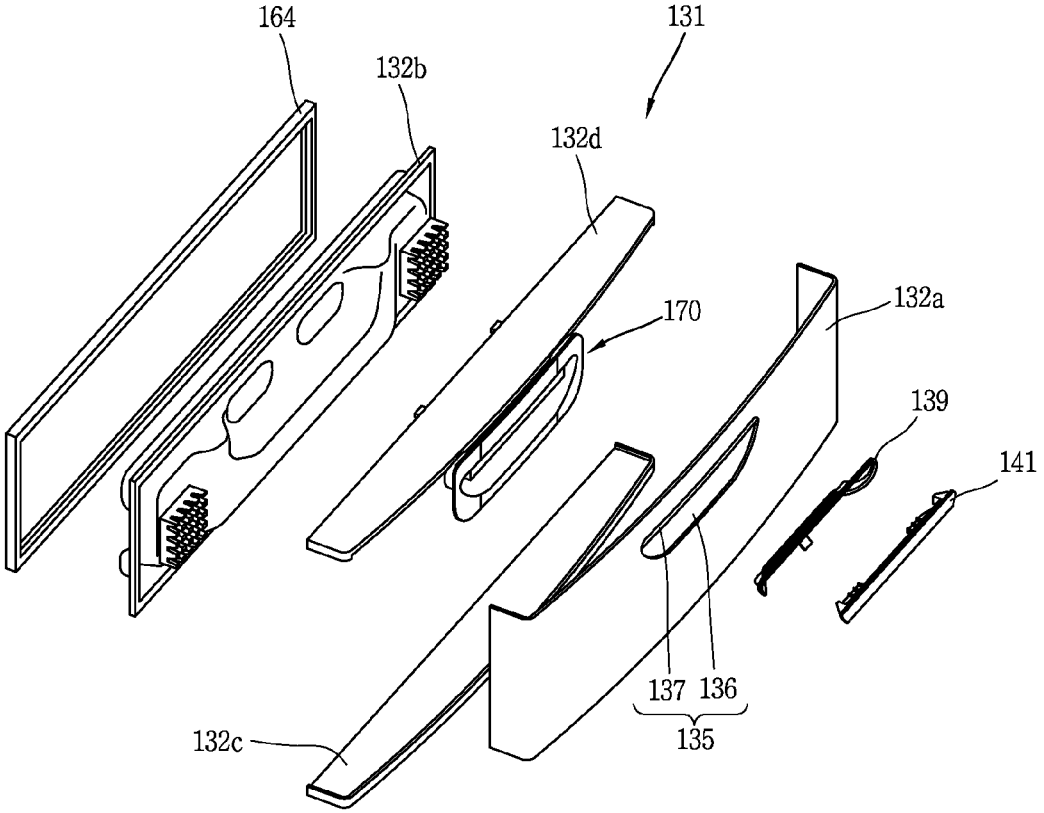
FIG. 5 is a disassembled perspective view of a door shown in FIG. 4.

The door main body 131, for example, as shown in FIG. 5, may include an outer plate 132*a* having the handle coupling part 135, an inner plate 132*b* disposed at an inner side of the outer plate 132*a* with a gap for filling a foaming agent (not shown) therebetween, and a pocket housing 170 located at the inner side of the outer plate 132*a* to receive the driving force transfer unit 190.

A lower cap 132*c* and an upper cap 132*d* may be disposed on a lower end and an upper end of the outer plate 132*a* and the inner plate 132*b* to cover the lower and upper sides, respectively. The outer plate 132*a* of the door main body 131, for example, may be made of a metal. The inner plate 132*b* of the door main body 131, for example, may be made of synthetic resin. The inner plate 132*b* of the door main body 131 may be provided with a gasket 164.

Meanwhile, the outer plate 132*a* may be formed in a pressing manner, for example. The outer plate 132*a* may include the handle coupling part 136 to which the door handle 141 may be coupled. The handle coupling part 135 may include a recess portion recessed into the front of the outer plate 132*a* to protrude to the rear of the outer plate 132*a*.

The handle coupling part 135 may include a penetrating portion 137 formed through a plate surface thereof. The penetrating portion 137 may be formed through the plate surface on an upper side of the recess portion 136.

Figure 11:
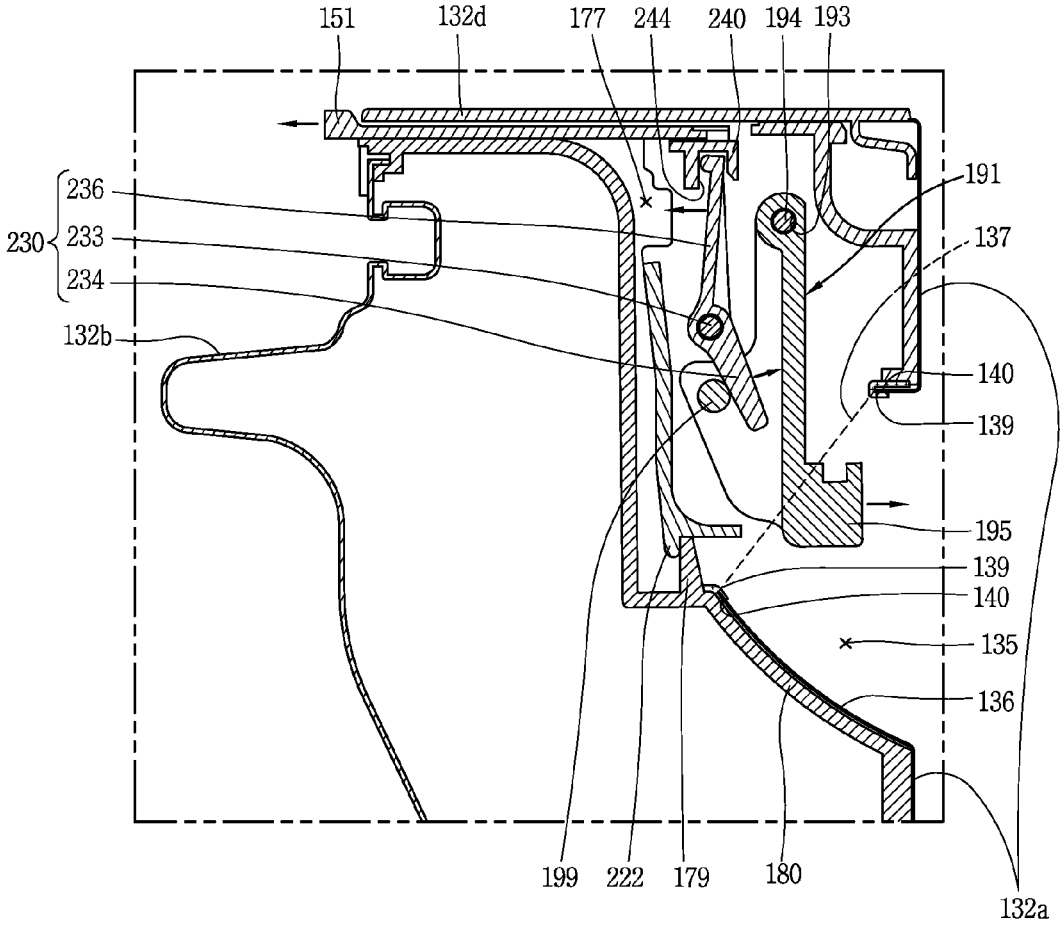
FIG. 11 is a sectional view showing a coupled state of the driving force transfer unit of FIG. 9.
Figure 12:
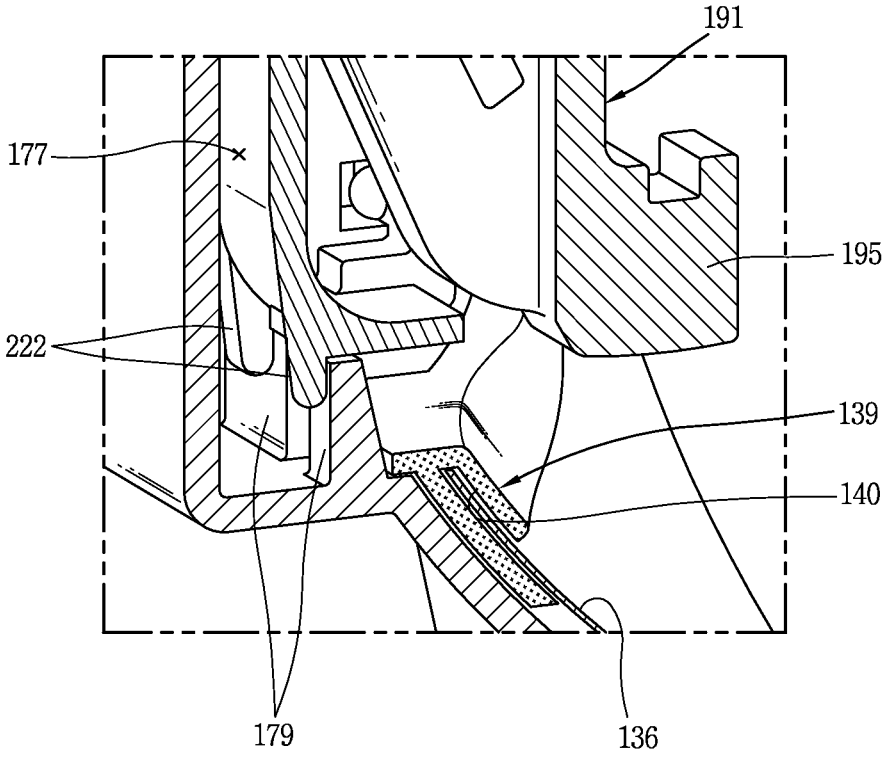
FIG. 12 is an enlarged perspective view showing main parts of FIG. 11.

A protection member 139 may be coupled to the penetrating portion 137 along an edge of the penetrating portion 137. This may prevent other components and/or a human body from being damage and/or hurt due to coming in contact with the edge of the penetrating portion 137. The protection member 139 may include an inserting portion 140 in which the edge of the penetrating portion 137 is inserted by a predetermined depth (see FIGS. 11 and 12). The protection member 139 may be formed as an elastic member (for example, a rubber member).

Pocket housing 170 may be located at the rear of the handle coupling part 135. The pocket housing 170 may be coupled onto a lower surface of the upper cap 132*d*. The pocket housing 170 may be coupled between the outer plate 132*a* and the inner plate 132*b* of the door main body 131 prior to foaming the door main body 131. Accordingly, an outer surface of the pocket housing 170 may be surrounded by a foaming agent after foaming the door main body 131.

Figure 6:
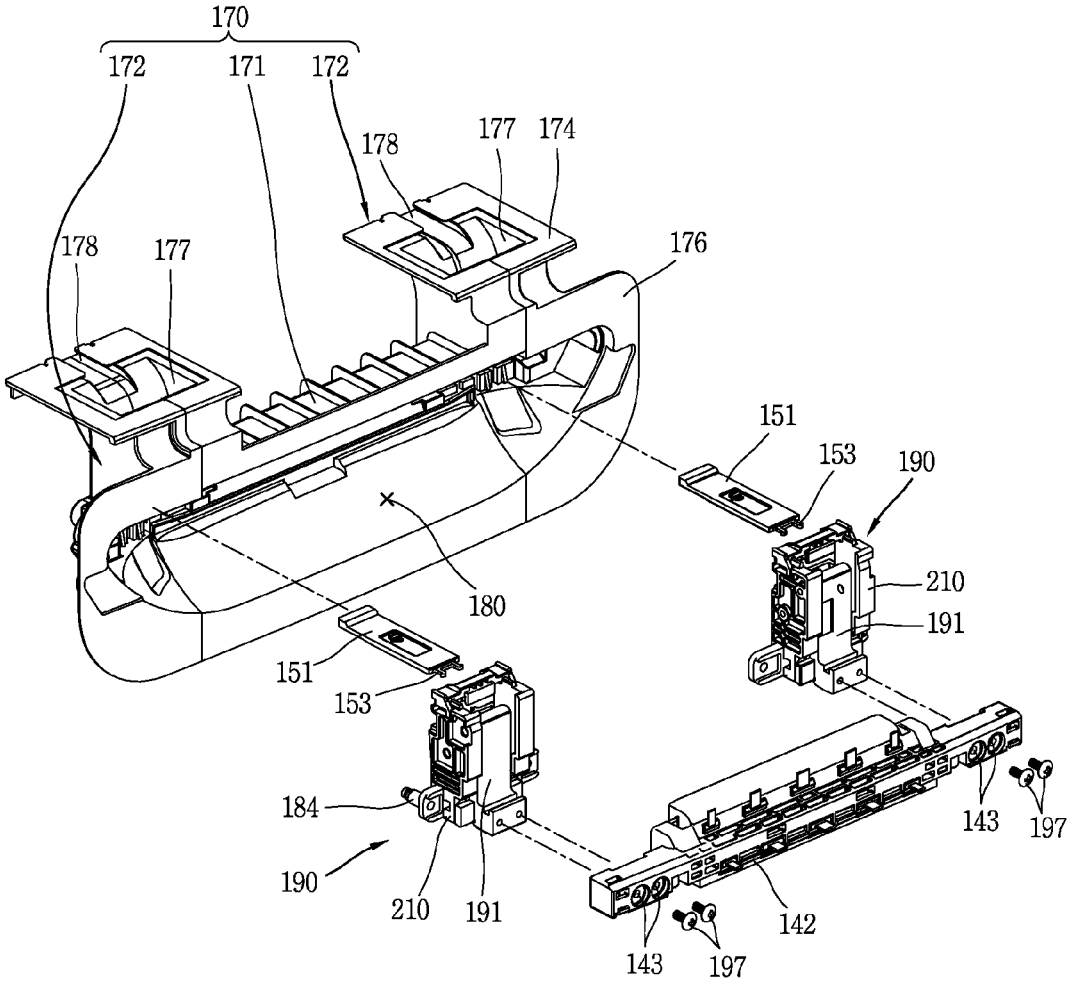
FIG. 6 is a perspective view prior to coupling a pocket housing, a driving force transfer unit and a door handle of FIG. 5.
Figure 7:
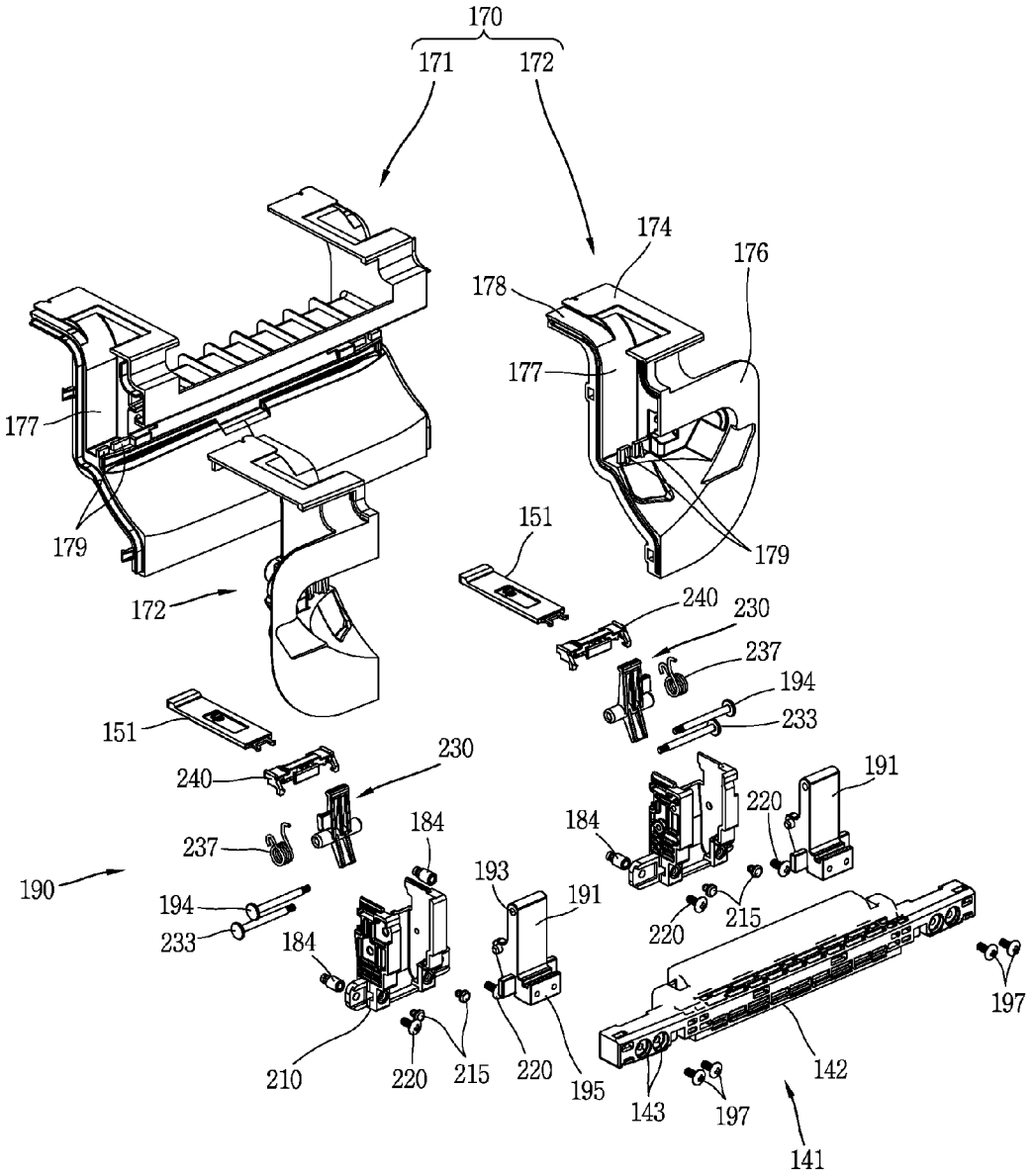
FIG. 7 is a disassembled perspective view of the pocket housing and the driving force transfer unit of FIG. 6.
Figure 8:
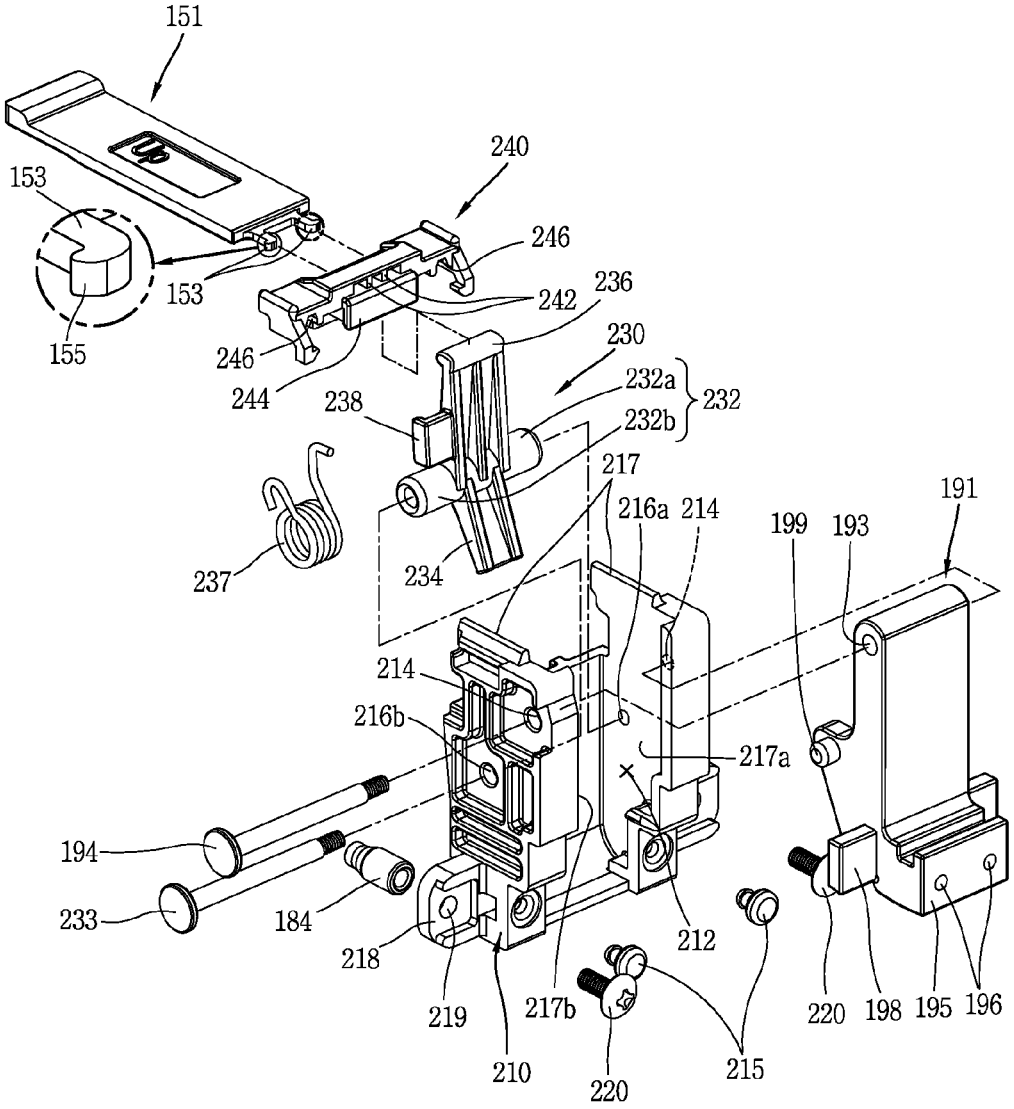
FIG. 8 is an enlarged view of the driving force transfer unit of FIG. 7.

Driving force transfer unit 190, as shown in FIGS. 6 to 8, for example, may include a lever 191 having one side connected to the door handle 141, a case 210 to rotatably support the lever 191, and a linker 230 having one side rotatable in response to the rotation of the lever 191. A head part 236 of the linker 230 may include a first coupling part 240 which is slideable. Accordingly, the slider 151 may be slideable in cooperation with the linker 230.

The lever 191 may have a shape like a bar with a predetermined length. A rotation axis hole 193 in which a rotation axis 194 is inserted may be formed through one end portion of the lever 191. A handle mounting portion 195 to which the door handle 141 is mounted may be provided on another end portion of the lever 191. The door handle 141, for example, may include a handle main body 142, and a handle cover 145 coupled to a front surface of the handle main body 142. Through holes 143 in which coupling members 187 coupled to the handle mounting portion 195 are inserted may be formed through both end portions of the handle main body 142.

Handle mounting portion 195 may protrude in a thickness direction. The handle mounting portion 195 may include female screws 196 into which the coupling members 197 are screwed. The lever 191 may include stoppers 198 to restrict rotation of the lever 191. The stoppers 198 may protrude from both sides of the handle mounting portion 195 in a widthwise direction. One side of the lever 191 may be shown, having the case 210 for rotatably supporting the lever 191.

A cavity 212 having a plurality of inner walls 217*a* and 217*b* may be formed on one side (on the front surface in the drawing) of the case 210. The lever 191 may be rotatably received in the cavity 212. Rotation axis holes 214 in which the rotation axis 194 of the lever 191 is inserted may be formed through the first inner wall 217*a* and the second inner wall 217*b* of the cavity 212, respectively. The cavity 212 may include a first linker axis supporting part 216*a* and a second linker axis supporting part 216*b* to support a linker axis 232 (i.e., a first linker axis 232*a* and a second linker axis 232*b*) of the linker 230. The first linker axis supporting part 216*a* may be formed on the first inner wall 217*a*. The second linker axis supporting part 216*b* may be formed on the second inner wall 217*b*.

Buffering members 215 for preventing a collision (impact) between the case 210 and the lever 191 may be disposed on a contact area between the case 210 and the lever 191. This may prevent an impact between the lever 191 and the case 210 when the door handle 141 comes back to its initial position, and also prevent generation of noise due to the impact. The buffer 215 may be made of an elastic material, for example. Buffer 215 may be contactable with the stopper 198. The buffer 215 may be inserted into a lower portion of the case 210.

A first coupling part 240 which is slideable with respect to the case 210 may be disposed on an upper end of the case 210. A guide way 217 to guide the sliding of the first coupling part 240 may be disposed on the upper end of the case 210. The guide way 217, for example, may protrude from the upper end of the case 210 and extend along back and forth directions. The first coupling part 240 may be provided with a guide part receiving portion 246 in which the guide way 217 is slideably received. The guide way receiving portion 246 may be upwardly recessed from a lower surface of the first coupling part 240.

The slider 151 may be detachably coupled to the first coupling part 240. Slider 151, for example, may be formed in a shape like a long plate or bar. The slider 151, for example, may include a second coupling part 153 detachably coupled to the first coupling part 240, and an elastic part 237 to allow the slider 151 to be restored into the door 130. One end portion of the slider 151 may be exposed to the outside of the door main body 131. Another end portion of the slider 151 may be inserted into the door main body 131 and coupled to the first coupling part 240.

Second coupling part 153 may be located on the another end portion of the slider 151. The second coupling part 153 may be provided in plurality (for example, two). The second coupling parts 153 may be spaced apart from each other by a predetermined distance. The second coupling parts 153 may be formed to be elastically transformed horizontal to a sliding direction of the slider 151. The first coupling part 240 may be provided with second coupling part grooves 242 in which the second coupling parts 153 are inserted and loosely coupled, respectively.

Each of the second coupling parts 153 may include a guide tilt portion 155 which is inclined (tilted) such that the second coupling part 153 can be pressed inwardly upon being inserted into the second coupling part groove 242. With the configuration, when the second coupling parts 153 are pressed into the second coupling part grooves 242, the second coupling parts 153 may be inwardly pressed by the guide tilt portions 155 such that their widths can be elastically changed, thereby being inserted into the second coupling part grooves 242. The second coupling parts 153 may be prevented from being separated from the second coupling part grooves 242 as they are restored to their initial positions by their own elastic forces after being inserted into the second coupling part grooves 242. In the meantime, when desiring to separate (detach) the second coupling parts 153, the second coupling parts 153 may be pulled with applying a force more than a predetermined level in a direction opposite to the insertion thereof. Accordingly, the second coupling parts 153 may be elastically transformed inwardly so as to be separated (detached) from the first coupling part 240 (in more detail, the second coupling part grooves 242).

Linker 230 which is rotatable in response to the rotation of the lever 191 may be located between the lever 191 and the first coupling part 240. The linker 230, for example, may include a body part 234 disposed within the cavity 212, and a first linker axis 232*a* and a second linker axis 232*b* to rotatably support the body part 234. The first linker axis 232*a* and the second linker axis 232*b* may be formed on both sides of the body part 234, respectively. The body part 234 may include one end portion (e.g., a lower end portion) connected to the door handle 141, and a head part 236 (e.g., an upper end portion) movable opposite to the one end portion upon the rotation of the linker 230.

Cavity 212 may include a first linker axis supporting part 216*a* and a second linker axis supporting part 216*b* to support the first linker axis 232*a* and the second linker axis 232*b* of the linker 230. The first linker axis supporting part 216*a* may be formed on the first inner wall 217*a* of the cavity 212, and the second linker axis supporting part 216*b* may be formed on the second inner wall 217*b*. The first linker axis supporting part 216*a* and the second linker axis supporting part 216*b* may be formed such that the coupling member 233, which is inserted through the first linker axis 232*a* and the second linker axis 232*b*, can be inserted therethrough.

The body part 234 may extend to the rear of the lever 191. The body part 234 may be coupled to be stopped at a body part stopping portion 199, which is formed on the rear of the lever 191. Accordingly, when the lever 191 is rotated by being pulled, the body part 234 may be pulled forward by the body part stopping portion 199, and accordingly the linker 230 may rotate cooperatively. The head part 236 may extend toward the first coupling part 240.

Alternatively, the linker may be directly coupled with the handle without the lever. Here, the body part of the linker may comprise a handle mounting portion, a stopper and a buffer to transfer the driving force from the movement of the handle 141 to the slider 151. The linker axis 232 (i.e., the first linker axis 232*a* and the second linker axis 232*b*), for example, may protrude by a predetermined length in a widthwise direction of the body part 234, and the case may provide a recessed receiving portion on the inside walls thereof to receive and support the first and second linker axes 232 protruded from the body part 234, and the case may be provided as a separate case to assemble the linker therein.

An elastic part 237 for restoring the slider 151 and/or the linker 230 to the initial position(s) may be provided on one side of the linker 230. Here, the initial position refers to a position (state) prior to the door handle 141 being rotated in response to a pulling force applied thereto to open the door main body 131. The slider 151 may be retracted into the door main body 131 at the initial position. The elastic part 237 may be implemented as a torsion spring, for example. The elastic part 237 may be coupled to an outside of the linker axis 232 such that the linker axis 232 can be inserted therein.

One end of the elastic part 237 may be fixed to the linker 230 and the other end thereof may be fixed to the pocket housing 170. Accordingly, the elastic part 237 may accumulate an elastic force when the linker 230 rotates, and restore the linker 230 to the initial position by use of the accumulated elastic force. The linker 230 may include a spring supporter 238 to support the one end portion of the elastic part 237. The head part 236 may be inserted into a head part inserting portion 244 formed on the first coupling part 240. Accordingly, upon the rotation of the linker 230, the first coupling part 240 may cooperatively be slid. The head part inserting portion 244 may be formed on a lower portion of the first coupling part 240 to be downwardly open. In the meantime, the case 210, for example, may include the first linker axis supporting part 216*a* formed on the first side wall 217*a* of the cavity 212 to support the first linker axis 232*a*, and the second linker axis supporting part 216*b* formed on the second side wall 217*b* of the cavity 212 to support the second linker axis 232*b*.

The driving force transfer unit 190 may be inserted into the pocket housing 170. A single receiving part 177, 180 may be formed in the pocket housing 170 so as to allow the door handle 141, the slider 151 and the driving force transfer unit 190 to be detachable individually. The pocket housing 170, for example, may include therein the receiving space 177 for the driving force transfer unit 190.

Pocket housing 170, for example, may include an inner housing 171, and outer housings 172 coupled to both end portions of the inner housing 171, respectively. This exemplary embodiment illustrates that the pocket housing 170 includes one inner housing 171 and two outer housings 172 to correspond to the door handle 141 having a relatively short length. However, when the handle is relatively long in length, the pocket housing may include inner housings and outer housings coupled to both end portions of the long handle in a manner of surface-to-surface contact.

An upper flange 174 which extends outwardly to have a surface-to-surface contact with the upper cap 132*d* may be formed on an upper end of the pocket housing 170. A front flange 176 which extends outwardly to have a surface-to-surface contact with the outer plate 132*a* of the door 130 may be formed on a front surface of the pocket housing 170. Here, this exemplary embodiment illustrates that the pocket housing 170 is disposed in the door main body 131, but the pocket housing 170 may also be configured to be partially extend to the outside of the door main body 131.

A handle installation space 180 corresponding to the handle coupling part 135 of the outer plate 132*a* of the door main body 131 may be formed in the pocket housing 170. The receiving part 177 for receiving the driving force transfer unit 190 (the case 210) may be formed on each of both end areas of the handle installation space 180. The receiving part 177, for example, may be formed to have an upper side and one side open. A slider inserting portion 178 in which the corresponding slider 151 is slideably inserted may be formed on one side of an upper portion of each receiving part 177.

Figure 9:
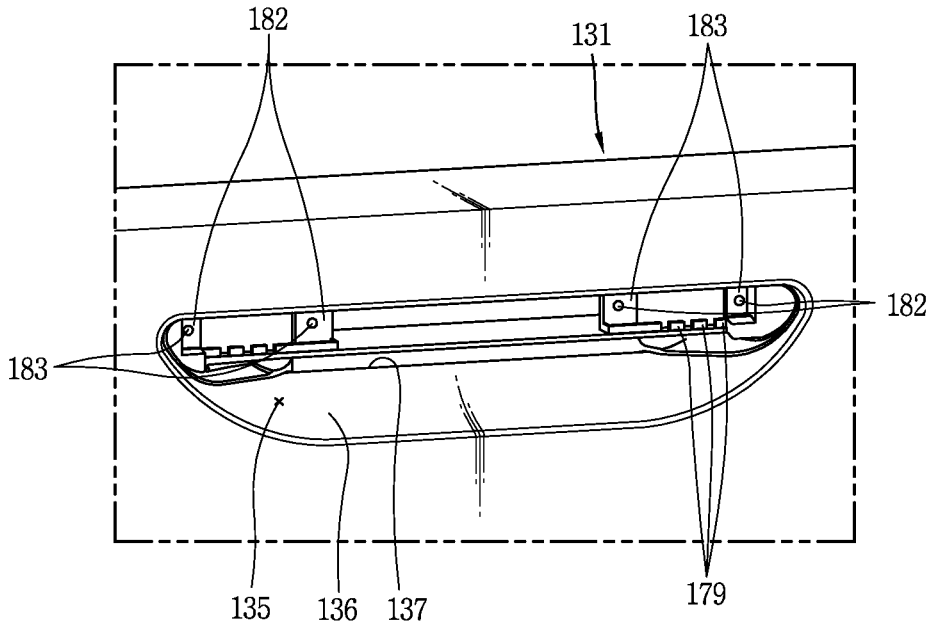
FIG. 9 is a view showing coupling of the pocket housing of FIG. 6.
Figure 10:
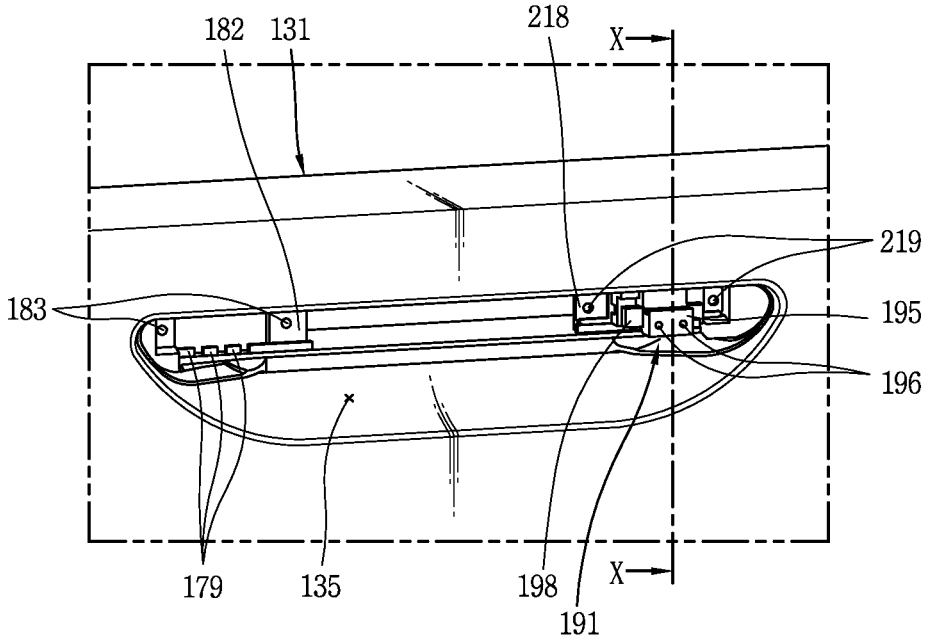
FIG. 10 is a perspective view after coupling the driving force transfer unit of FIG. 9.

As shown in FIGS. 9 and 10, each of the receiving parts 177, in more detail, may be formed such that a side facing the door handle 141 is open. Accordingly, the handle mounting portion 195 of the lever 191 may protrude toward the door handle 141 to be coupled to the door handle 141. Each of the receiving parts 177 may include a supporting protrusion 179 for preventing the case 210 from being drawn out when the door handle 141 is pulled.

The supporting protrusion 179, for example, may be formed on a lower portion of each receiving part 177. The case 210 may be provided with a contact protrusion 222 which comes in contact with the supporting protrusion 179. The contact protrusion 222 may be disposed at the rear side of the supporting protrusion 179. The supporting protrusion 179 and the contact protrusion 222 may be provided in plurality, respectively. The supporting protrusions 179 may upwardly protrude from the lower portion of the receiving part 177 and be spaced apart from each other by a predetermined gap along a right and left direction of the door main body 131 (or a lengthwise direction of the door handle 141).

Contact protrusions 222 may downwardly protrude from a lower portion of the case 210 and be spaced apart from each other by a predetermined gap in a right and left direction of the case 210. Here, the contact protrusions 222 formed on the lower portion of the case 210 may be inserted into the gap between the supporting protrusions 179. Accordingly, the case 210 may be coupled (screw-coupled) by being horizontally moved by a predetermined distance after the contact protrusion 222 is inserted through the gap between the supporting protrusions 179 from the front of the supporting protrusions 179 to the rear of the supporting protrusions 179.

The case 210 may be provided with protrusions 218 coupled to the pocket housing 170. The protrusions 218 may protrude from both sides of the case 210. Each of the protrusions 218 may include a through hole 219 in which a coupling member 220 coupled to the pocket housing 170 is inserted.

The pocket housing 170 may be provided with protrusion inserting portions 182 in which the protrusions 218 are inserted. Each of the protrusion inserting portions 182 may include a through hole 183 through which the coupling member 220 is inserted. The pocket housing 170 may be provided with a female screw member 184 to which each coupling member 220 inserted through the through hole 183 is coupled. The female screw member 184, for example, may be formed as a separate member (for example, a metallic member) to be located at the rear side (rear surface) of the protrusion inserting portion 182 of the pocket housing 170.

With this configuration, when the door handle 141 is gripped and pulled forwardly to open the freezing chamber 122, the lever 191 may be rotated forwardly based on the rotation shaft 194. In response to the forward rotation of the lever 191, the linker 230 disposed at the rear of the lever 191 may be rotated. In more detail, when the body part 234 located at the rear of the lever 191 is pulled forwardly, the head part 236 may be rotated backwardly centering around the rotation shaft 233.

In response to the backward rotation of the head part 236, the first coupling part 240 may be slid backwardly. Accordingly, the slider 151 may protrude to the rear of the door main body 131. The slider 151 protruded from the door main body 131 may come in contact with an edge area of a front opening of the freezing chamber 122 so as to press the door main body 131 in an opening direction. This may facilitate for opening of the door main body 131.

When the force of pulling the door handle 141 is released, the door handle 141 and the slider 151 may come back to their initial positions by the linker 230 which is restored to the initial position by an elastic force of the elastic part 237. In the meantime, for inspecting the driving force transfer unit 190, the door handle 141 may be pulled forwardly to move the door main body 131 in the opening direction.

When an exposed end portion of the slider 151 is pulled outwardly (i.e., a direction of being farther away from the door main body 131) with a force more than a predetermined level, the second coupling part 153 of the slider 151 may be elastically transformed inwardly and accordingly the coupled state with the second coupling part groove 242 may be released. The slider 151 may thusly be detached. When the slider 151 is detached, the door handle 141 may be separated from the lever 191. When the door handle 141 is separated from the lever 191, the coupling member 220 coupled to the case 210 may be exposed.

After the coupling member 220 is separated from the case 210, the case 210 of the driving force transfer unit 190 may be moved in a horizontal direction, opposite to the direction of the case 210 being coupled. Here, when the case 210 is moved forward in the horizontal direction with aligning each contact protrusion 222 of the case 210 between the supporting protrusions 179, the case 210 may be easily drawn out. This may facilitate for inspection and/or repair of the driving force transfer unit 190.

Figure 13:
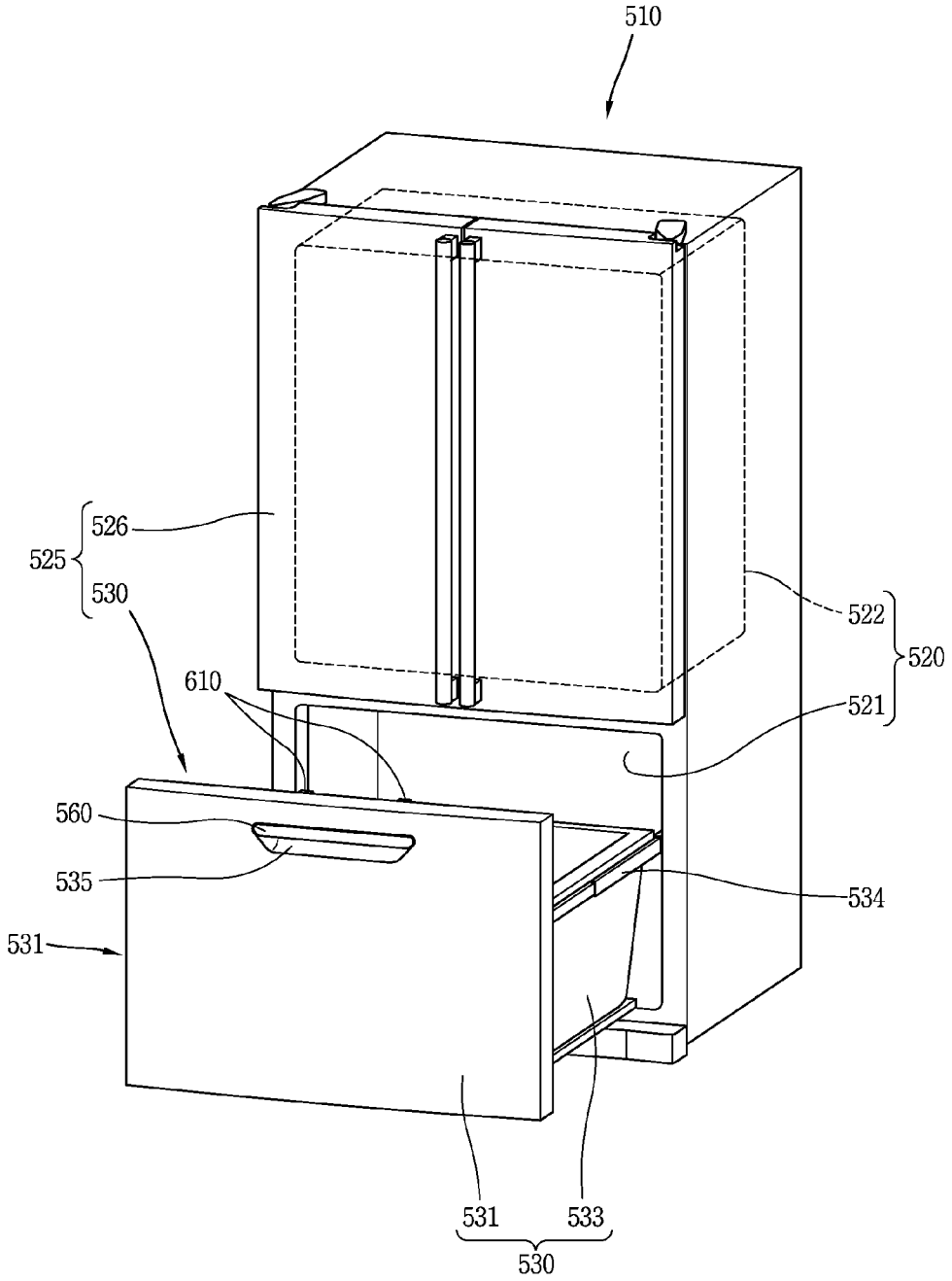
FIG. 13 is a perspective view of a refrigerator in accordance with one exemplary embodiment.

Hereinafter, other exemplary embodiments will be described with reference to FIGS. 13 to 24. As shown in FIG. 13, a refrigerator may include a refrigerator main body 510 having a plurality of compartments 520, and a door 525 for opening and closing front openings of the compartments 520. The refrigerator main body 510, as well known, may include a refrigerating cycle system (not shown) for supplying cold air into the compartments 520.

The refrigerator main body 510, for example, may include a refrigerating chamber 522 in an upper region, and a freezing chamber 521 in a lower region. The doors 525 may include a door 526 for opening and closing the compartments 520 in a rotating manner, and a door 530 for opening and closing the compartments 520 in a sliding manner. The door 530 for the refrigerator according to the one exemplary embodiment may be provided on a front surface of the refrigerator main body 510.

The door 530 for the refrigerator in accordance with the one exemplary embodiment may include a door main body 531, a door handle 560 movably disposed on the door main body 531 to facilitate for opening of the door main body 531, at least one slider 610 extending toward the refrigerator main body 510 in response to movement of the door handle 560, at least one driving force transfer unit 630 located between the door handle 560 and the slider 610 to transfer a driving force, generated when the door handle 560 is pulled, to the slider 610, and a pocket housing 570 partially buried in the door main body 531 to receive therein the door handle 560, the slider 610 and the driving force transfer unit 630 such that they can be detachable individually.

The driving force transfer unit 630 may include a linker 631 having a linker body part 636, and a first linker axis 634*a* and a second linker axis 634*b* for rotatably supporting the linker body part 636, a first linker axis supporting part 584 (see FIG. 23) disposed on the pocket housing 570 to support the first linker axis 634*a*, and a second linker axis supporter 650 detachably coupled to the pocket housing 570 to support the second linker axis 634*b*. The door 530 for the refrigerator according to the one exemplary embodiment may include a refrigerating chamber door 526 and/or a freezing chamber door 530.

As described herein, the freezing chamber door 530 for opening and closing the freezing chamber 521 will be exemplarily illustrated as the door for the refrigerator, and the freezing chamber door 530 will be exemplarily illustrated as a drawer type door for opening and closing the freezing chamber 521 in a sliding manner. Refrigerating chamber door 526 for opening and closing the refrigerating chamber 522 may be provided on a front surface of the refrigerating chamber 526. The refrigerating chamber door 526, for example, may be provided as a pair for opening and closing the refrigerating chamber 522 in a rotating manner.

The door 530 (i.e., the freezing chamber door 530) for the refrigerator may include a door main body 531 disposed on the front surface of the freezing chamber 521 for closing or opening a front opening of the freezing chamber 521, and a food storage part 533 disposed on the rear of the door main body 531 for storing foodstuffs. Rails 534 may be disposed on side walls of the food storage part 533 and the freezing chamber 521. Accordingly, the door main body 531 and the food storage part 533 may be smoothly slideable back and forth.

Figure 14:
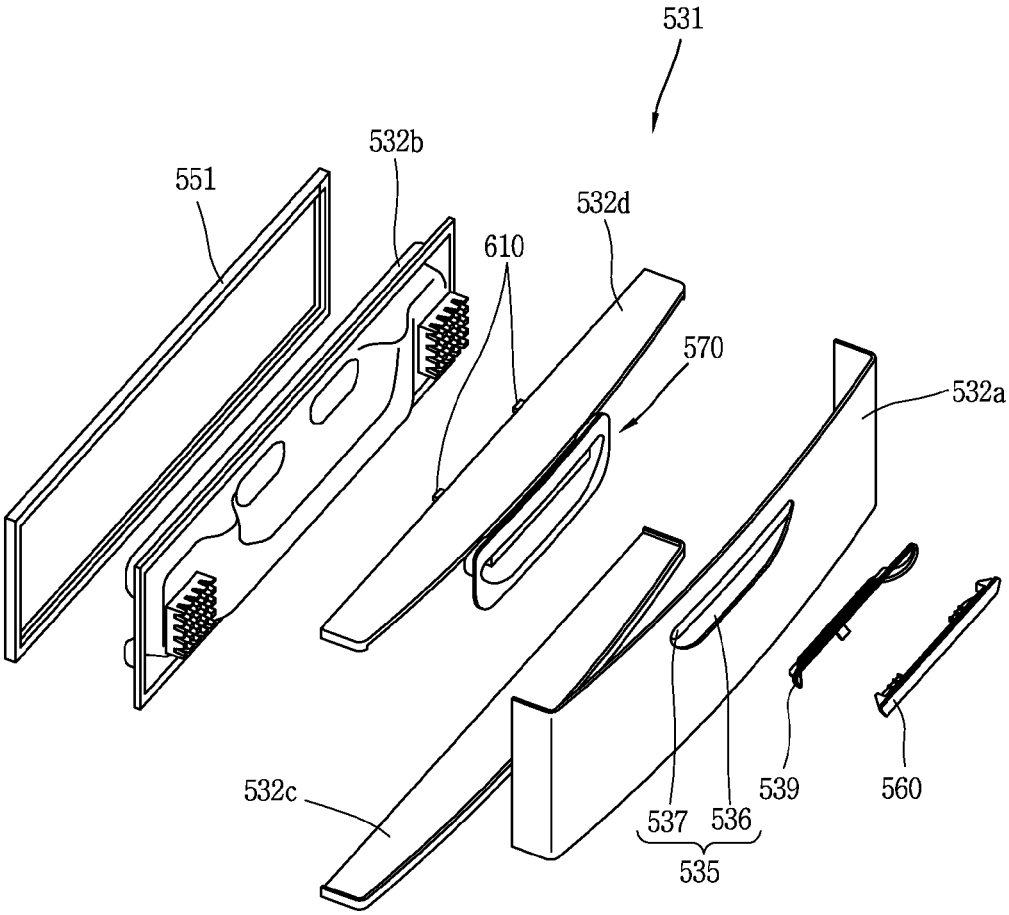
FIG. 14 is a disassembled perspective view of a door shown in FIG. 13.

A door handle 560 may be disposed on the front surface of the door main body 531. The door main body 531, as shown in FIG. 14, may include an outer case 532*a* defining an appearance, an inner case 532*b* disposed at an inner side of the outer case 532*a* with a gap from the outer case 532*a* for filling a foaming agent (not shown), a lower cap 532*c* disposed to cover lower ends of the outer case 532*a* and the inner case 532*b*, and an upper cap 532*d* disposed to cover upper ends of the outer case 532*a* and the inner case 532*b*. The inner case 532*b* of the door main body 531 may be provided with a gasket 551. The outer case 532*a* of the door main body 531, for example, may be made of a metal.

The inner case 532*b*, the lower cap 532*c* and the upper cap 532*d* of the door main body 531 may be formed of synthetic resin. The outer case 532*a* of the door main body 531 may be formed in a pressing manner. A handle coupling part 535 to which the door handle 560 is coupled may be formed on a front surface of the outer case 532*a*. The handle coupling part 535 may include a recess portion 536 which is pressed from the front surface and recessed backwardly. The handle coupling part 535, for example, may have a greater size than the door handle 560 such that the door handle 560 can be received therein. The handle coupling part 535 may be provided with a penetrating portion 537 formed through a plate surface thereof.

Penetrating portion 537 may be located on an upper side of the recess portion 536. The penetrating portion 537 may include a protection member 539. This may prevent other components and/or a human body from being damage and/or hurt due to coming in contact with the edge of the penetrating portion 537. The protection member 539, for example, may be formed as an elastic member (rubber, silicon resin). Protection member 539 may include an inserting portion 540 in which the edge of the penetrating portion 537 is inserted by a predetermined depth (see FIGS. 16, 23 and 24). Accordingly, the protection member 539 may stably be coupled to the edge of the penetrating portion 537.

The door handle 560, for example, may include a handle main body 561, and a handle cover 565 disposed on a front surface (outer surface) of the handle main body 561. The handle cover 565, for example, may be disposed on the front surface of the handle main body 561 and engaged with the handle main body 561 using a hook (not shown) and the like. Coupling member inserting holes 563 in which the coupling members 564 for coupling the door handle 560 to the linker 631 are inserted may be formed through both end portions of the handle main body 561. The coupling member inserting holes 563 may be provided in plurality, respectively.

A pocket housing 570 may be disposed in the door main body 531. The pocket housing 570 may communicate with the handle coupling part 535 to receive the linker 631 and the slider 610 therein. Pocket housing 570 may include a receiving part 575, 577 exposed to the outside of the outer case 532*a* of the door 530 to receive therein the door handle 560, the linker 631 and the slider 610 such that at least one area thereof can be drawn outwardly, and a sliding guide part 578 disposed between the outer case 532 and the inner case 532*b* of the door 530. The pocket housing 570, for example, may be coupled to a lower surface of the upper cap 532*d*. The pocket housing 570 may come in contact with an inner surface of the outer case 532*a* of the door 530. The pocket housing 570 may include an upper flange 574 extending outwardly to have a surface-to-surface contact with the lower surface of the upper cap 532*d*. The pocket housing 570 may include a front flange 576 extending outwardly to have a surface-to-surface contact with the inner surface of the outer case 532*a* of the door 530.

A handle installation space 575 corresponding to the handle coupling part 535 of the outer case 532*a* of the door 530 may be disposed in the pocket housing 570. The handle installation space 575 may be recessed inwardly from the front flange 576 to correspond to the shape of the handle coupling part 535. A receiving space 577 for receiving the slider 610 and the driving force transfer unit 630 may be disposed in each of both side areas of the handle installation space 575.

Each of the receiving spaces 577 may communicate with the handle installation space 575 to form a single receiving part. That is, the single receiving part 575, 577 may receive therein the door handle 560, the linker 631 and the slider 610 such that at least one area thereof can be drawn outwardly. Accordingly, the slider 610 and the driving force transfer unit 630 may be detachably inserted into the receiving space 577 through the handle coupling part 535 (i.e., handle installation space 575).

Figure 15:
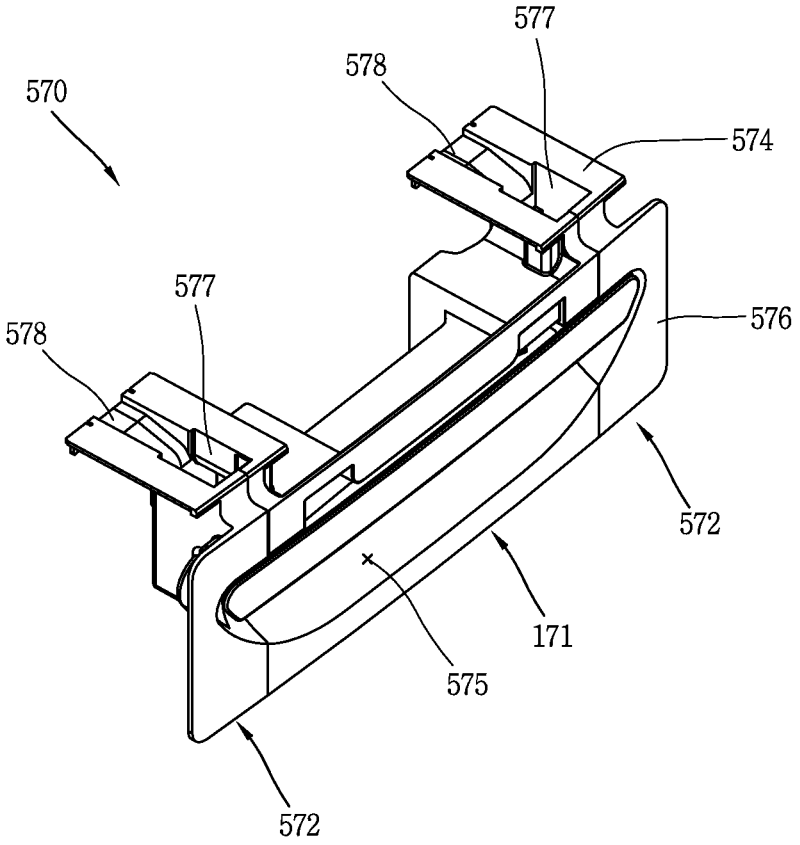
FIG. 15 is a perspective view showing a coupled state of a pocket housing and a door handle shown in FIG. 14.
Figure 16:
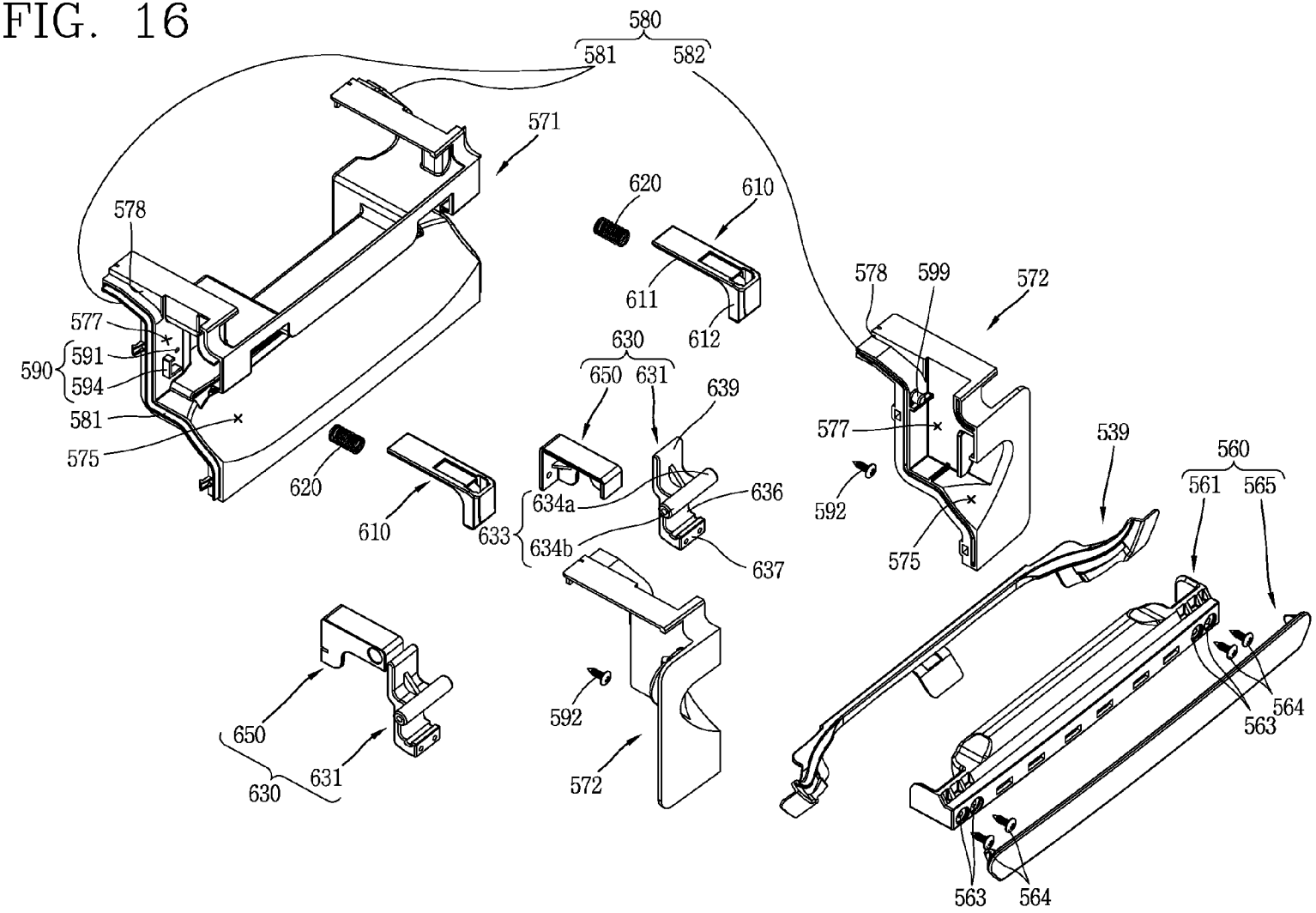
FIG. 16 is a disassembled perspective view of the pocket housing, a linker and the handle of FIG. 15.
Figure 19:
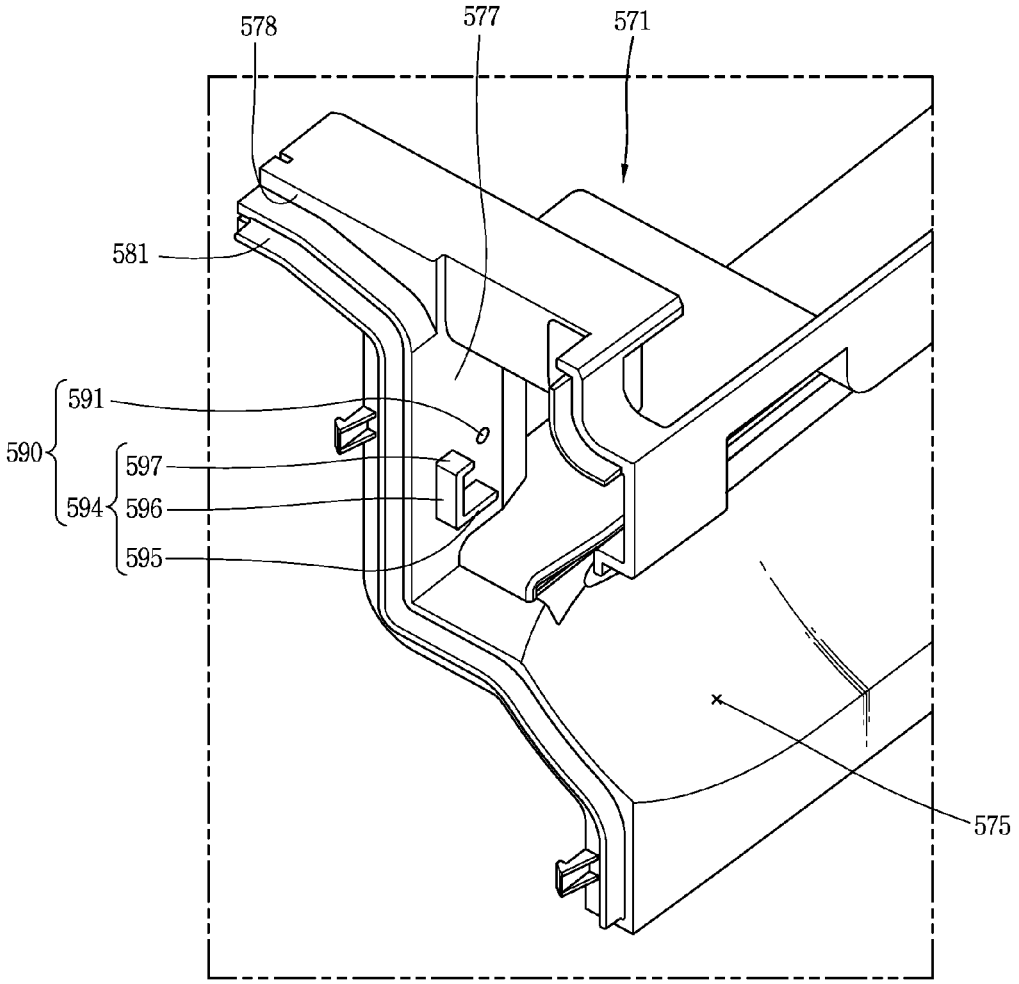
FIG. 19 is an enlarged view showing an inside of an inner housing of FIG. 16.
Figure 20:
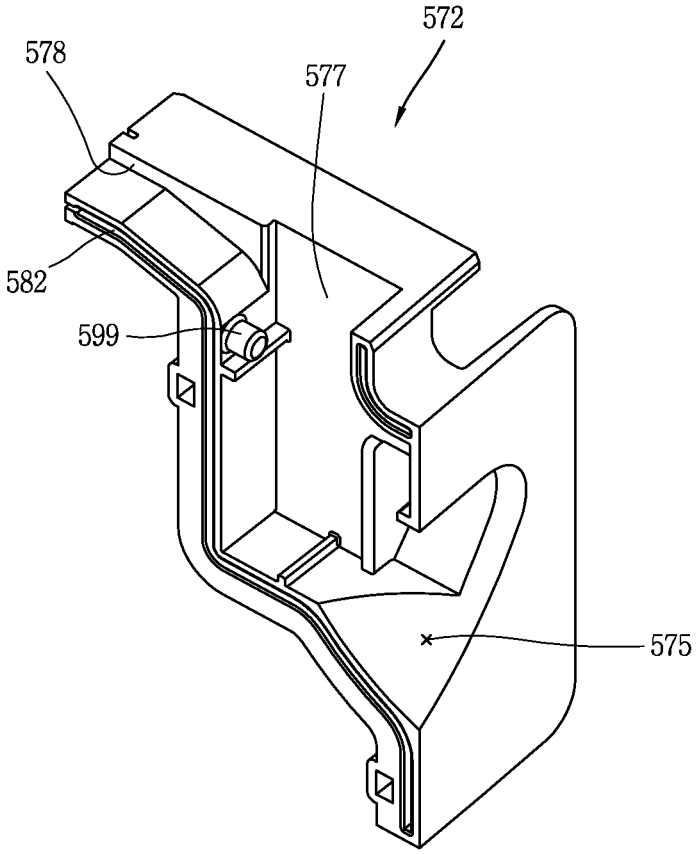
FIG. 20 is an enlarged view showing an inside of an outer casing of FIG. 16.

In more detail, for example, the pocket housing 570, as shown in FIGS. 15 and 16, may include an inner housing 571 located in a central portion, and outer housings 572 disposed on both ends of the inner housing 571. Engagement parts 580 may be located on contact areas between the inner housing 571 and the outer housings 572, which may allow the inner housing 571 and the outer housings 572 to be firmly coupled to each other. Each of the engagement parts 580, for example, as shown in FIGS. 19 and 20, may include a coupling rib 581 protruding from one of contact surfaces of the inner housing 571 and the outer housing 572, and a coupling rib receiving portion 582 formed on the other of the contact surfaces of the inner housing 571 and the outer housing 572 to receive the coupling rib 581 therein. This exemplary embodiment illustrates that the coupling rib 581 is formed on the inner housing 571 and the coupling rib receiving portion 582 is formed on the outer housing 572.

The receiving spaces 577 may be formed on the inner housing 571 and the outer housing 572 with being partially separated. The linker 631 may include a linker body part 636, and a first linker axis 634*a* and a second linker axis 634*b* for rotatably supporting the linker body part 636. The linker body part 636 may include a linker head part 639 contactable with the slider 610. Linker head part 639 may come in contact with the slider body part 612 of the slider 610. The linker axis 633 (i.e., the first linker axis 634*a* and the second linker axis 634*b*) may be located approximately in the middle between the linker body part 636 and the linker head part 639. The linker axis 633 (i.e., the first linker axis 634*a* and the second linker axis 634*b*) may include a through hole formed along a center of an axis. This may result in reduction of consumption of a material and prevention of deformation due to shrinkage.

Linker body part 636 may extend to a lower side of the linker axis 633, and the linker head part 639 may extend to an upper side of the linker axis 633. The linker body part 636 may include a handle mounting portion 637 to which the door handle 560 is mounted. The handle mounting portion 637 may protrude toward the door handle 560, for example. The handle mounting portion 637 may include a female screw 638 into which the coupling member 564 inserted through the coupling member inserting hole 563 of the handle main body 561 is screwed.

The linker axis 633 may have a more extended width than widths of the linker body part 636 and the linker head part 639. The linker axis 633 may protrude to both sides of the linker body part 636 and the linker head part 639. One end portion of the linker axis 633 (the second linker axis 634*b*) may be supported by the second linker axis supporter 650. The other end portion of the linker axis 633 (first linker axis 650) may be supported by the pocket housing 570. The pocket housing 570, for example, may include the first linker axis supporting part 584 (see FIG. 23) for rotatably receiving and supporting the other end of the linker axis 633.

In more detail, the first linker axis supporting part 584 may be formed on each of the outer housings 572. The second linker axis supporter 650 may include a body part 651, and a second linker axis supporting part 657 formed on the body part 651 for rotatably receiving and supporting an end portion of the linker axis 633 (the second linker axis 634*b*). The body part 651 may include a fastening part 655 for fixing the second linker axis supporter 650 to the pocket housing 570 and selectively releasing the fixed second linker axis supporter 650. The fastening part 655, for example, may be formed through the body part 651 to allow for insertion of a coupling member 592 therethrough, which is coupled to the pocket housing 570 by being inserted through the body part 651.

Figure 17:
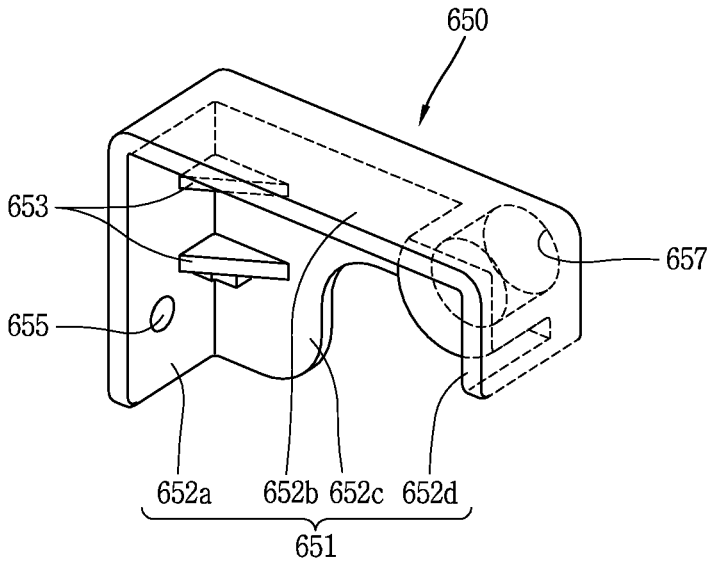
FIG. 17 is a perspective view showing an inside of a second linker axis supporter of FIG. 16.
Figure 18:
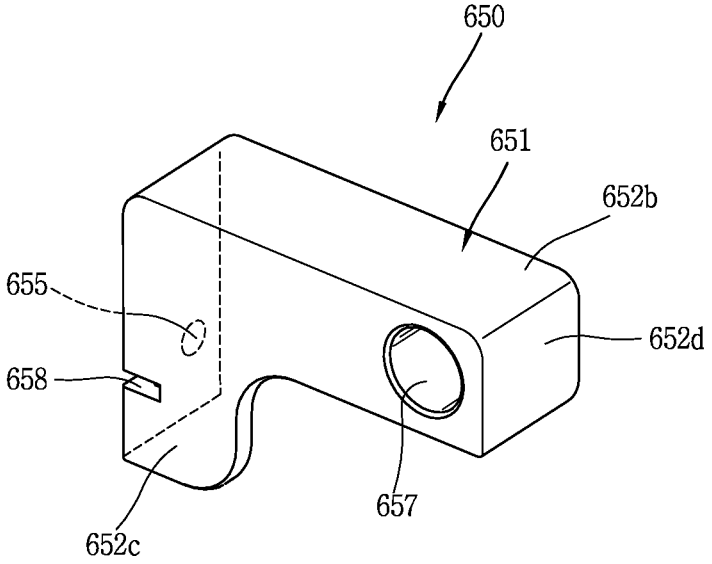
FIG. 18 is an enlarged perspective view of the second linker axis supporter of FIG. 16.

The body part 651, for example, as shown in FIGS. 17 and 18, may include a perpendicular portion 652*a*, a horizontal portion 652*b* bent from the perpendicular portion 652*a*, and a side portion 652*c* formed to connect one sides of the perpendicular portion 652*a* and the horizontal portion 652*b*. A bent portion 652*d* may be downwardly bent from an end of the horizontal portion 652*b*. The body part 651 may include a connecting portion 653 for coupling the perpendicular portion 652*a* to the side portion 652*c*. The connecting portion 653 may be provided as a plurality, which are spaced from each other in a vertical direction.

Second linker axis supporting part 657 may be spaced apart from the connecting portion 653 and come in contact with the horizontal portion 652*b* and the bent portion 652*d*. Accordingly, the linker axis 633 may be stably supported. The body part 651 may be installed such that the perpendicular portion 652*d* can be in a surface-contact state with the pocket housing 570. The perpendicular portion 652*a* may be provided with the fastening part 655 in which the coupling member 592 screwed into the pocket housing 570 is inserted upon coming in contact with the pocket housing 570.

The second linker axis supporter 650 may include a rib slit 658 in which a rib 597 protruding from the pocket housing 570 is inserted. The rib slit 658 may be formed on both the perpendicular portion 652*a* and the connecting portion 653. In more detail, a second linker axis supporter coupling part 590, as shown in FIG. 19, may be provided on the inner housing 571. The second linker axis supporter coupling part 590, for example, may include a coupling member coupling part 591 in which the coupling member 592 inserted through the second linker axis supporter 650 is inserted. Here, a female screw member (not shown) may be provided at the rear of the coupling member coupling part 591. The female screw member, for example, may be made of a metal and disposed at the rear of the pocket housing 570. This may result in stable coupling of the second linker axis supporter 650 and the pocket housing 570 to each other.

Second linker axis supporter coupling part 590 may includes a rotation preventing part 594 disposed to come in contact with the second linker axis supporter 650 so as to prevent the rotation of the second linker axis supporter 650. The rotation preventing part 594, for example, may come in contact with an outer side of the second linker axis supporter 650. In more detail, for example, the rotation preventing part 594 may protrude from a surface of the pocket housing 570 and come in contact with the outer side of the second linker axis supporter 650 so as to prevent the rotation of the second linker axis supporter 650.

Rotation preventing part 594 may include a lower supporting part 595 disposed on a lower side of the second linker axis supporter 650. The rotation preventing part 594 may include a side supporting part 596 disposed on a side portion of the second linker axis supporter 650. The lower supporting part 595 and the side supporting part 596 may protrude from an inner surface of the pocket housing 570. The rotation preventing part 594 may include both the lower supporting part 595 and the side supporting part 596.

The rotation preventing part 594 may guide the second linker axis supporter 650 to be aligned on a correct assembling position upon coupling of the second linker axis supporter 650, thereby facilitating for insertion of the coupling member 592. Also, the rotation preventing part 594 may prevent the second linker axis supporter 650 from moving in a plate surface direction, so as to support the second linker axis supporter 650 against an external force applied in a horizontal direction. This may allow for the reduction of the number of screws required for coupling the second linker axis supporter 650 to the pocket housing 570, resulting in reduction of an assembling time. Also, with reduction of the number of screws (or bolts) and female screws (nuts), a fabricating cost may be decreased. The rotation preventing part 594 may include a rib 597 inserted into the second linker axis supporter 650. The rib 597, for example, may be inserted into the second shaft supporter 650.

In more detail, the rib 597 may protrude from an upper end of the side supporting part 596 in right and left directions. The rib 597 may be inserted into the rib slit 658 of the second linker axis supporter 650. Accordingly, the second linker axis supporter 650 may be coupled more firmly and the linker axis 633 may be supported more stably. The sliders 610 may be received on an upper region within the pocket housing 570. The slider 610 may include a sliding part 611 extending from and retracting in the door main body 531, and a slider body part 612 for supporting the sliding part 611.

Slider 610 may include an elastic part 620 which allows the slider body part 612 to come in contact with the linker head part 639 of the linker 631. The sliding part 611 may be located within a sliding guide part 578 of the pocket housing 570. The slider body part 612 may be bent from one end of the sliding part 611. The sliding part 611 of the slider 610 may be formed in a shape of a long plate so as to be slideable horizontally. The bent portion 652*d* may be bent downwardly from one end of the sliding part 611 so as to have a shape like a reverse "L." The pocket housing 570 may include the sliding guide part 578 which slideably receives and guides the sliding part 611. The elastic part 620 which restores the slider 610 to the initial position may be placed at one side of the slider 610.

Figure 21:
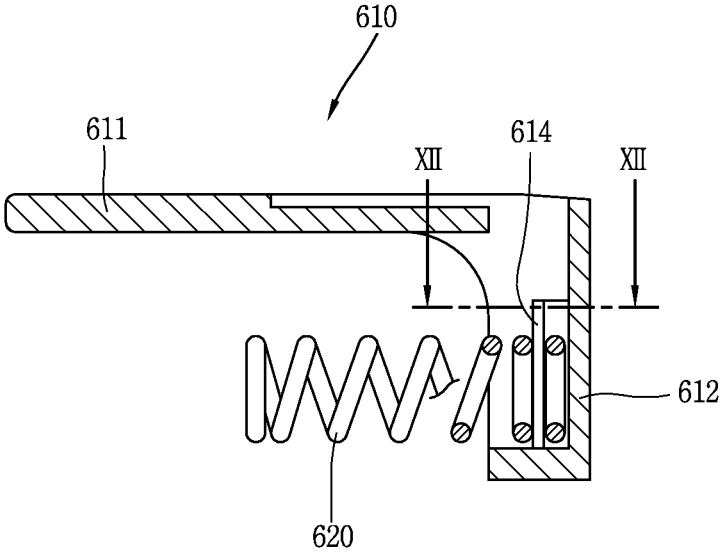
FIG. 21 is a sectional view showing a coupled state of a slider and an elastic part of FIG. 16.
Figure 22:
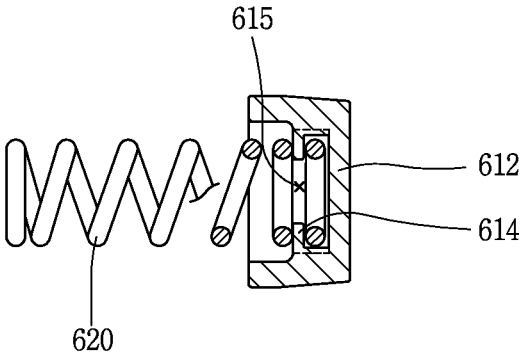
FIG. 22 is a horizontal sectional view of an elastic part fixing unit of FIG. 21.

An elastic part fastening part 614 to fix the elastic part 620 may be disposed on the slider 610. The elastic part 620, for example, may be implemented as a compression coil spring which is expanded and contracted in a sliding direction of the slider 610. The elastic part fastening part 614 may be inserted in a radial direction into one end portion of the compression coil spring. In more detail, as shown in FIGS. 21 and 22, the elastic part fastening part 614 may be formed at an inner side of the sliding body part 612.

The elastic part fastening part 614 may have an upper side open and a lower side blocked such that one end portion of the elastic part 620 can be received therein. The elastic part fastening part 614 may include a slot 615 formed at a central portion of the fastening part 614 by being downwardly cut from an upper end of the elastic part fastening part 614 such that the elastic part 620 can be drawn out therethrough.

An elastic part supporting part 599 to support the other end of the elastic part 620 may be placed in the pocket housing 570. The elastic part supporting part 599, for example, as shown in FIG. 20, may be inserted into the other end of the elastic part 620. In more detail, the elastic part supporting part 599 may have a shape of a circular rod (protrusion) having an outer diameter smaller than an inner diameter of a coil of the elastic part 620. Accordingly, when the elastic part 620 is expanded and contracted, the end of the elastic part 620 may be prevented from being separated.

With the configuration, the door main body 531 may be formed by coupling the pocket housing 570 to the lower portion of the upper cap 532*d*, assembling the outer case 532*a*, the inner case 532*b*, the lower cap 532*c* and the upper cap 532*d* together, and filling a foaming agent (not shown) in the assembled structure. The slider 610, the driving force transfer unit 630 and the door handle 560 may be coupled together by use of the handle coupling part 535 of the door main body 531. The slider 610, the linker 610 and the door handle 560 may sequentially be coupled into the single receiving part 575, 577 within the pocket housing 570. In more detail, the one end portion of the elastic part 620 may be inserted into the elastic part fastening part 614 of the slider 610. This may facilitate for assembling of the elastic part 620.

The slider 610 may be inserted into the corresponding receiving space 577 through the handle coupling part 535. The slider 610 may be supported and/or maintained in a slideable state with respect to the pocket housing 570, by inserting the front end of the sliding part 611 into the sliding guide part 578 of the pocket housing 570 and coupling a free end of the elastic part 620 to the elastic part supporting part 599. The linker 631 may be inserted into the handle coupling part 535 to be inserted into the receiving space 577 of the pocket housing 570.

One end of the linker axis 633 of the linker 631 may be inserted into the first linker axis supporting part 584 of the pocket housing 570. The linker head part 639 may be located at one side (at the front in the drawing) of the bent portion 652*d* of the slider 610. The second linker axis supporter 650 may be inserted into the receiving space 577 through the handle coupling part 535. The second linker axis supporter 650 may be coupled such that the side wall 652*c* can face the linker axis 633 and the other end portion of the linker axis 633 can be received in the second linker axis supporting part 657.

When the perpendicular portion 652*a* of the second linker axis supporter 650 contacts the pocket housing 570 by surface to surface, the lower supporting part 595 and the side supporting part 596 may come in contact with the lower end and the side surface of the second linker axis supporter 650, respectively. Here, the rib 597 of the pocket housing 570 may be inserted into the rib slit 658 of the second linker axis supporter 650. The coupling members 592 may be inserted into the coupling member inserting portions 255 of the second linker axis supporter 650, and then screwed into the pocket housing 570.

Figure 23:
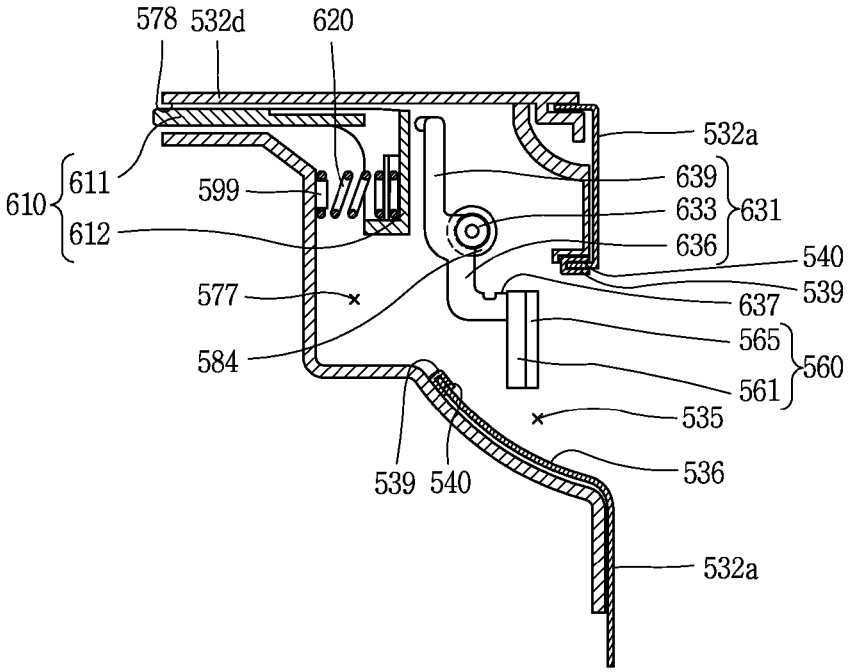
FIG. 23 is a sectional view showing main parts of the door of FIG. 13.
Figure 24:
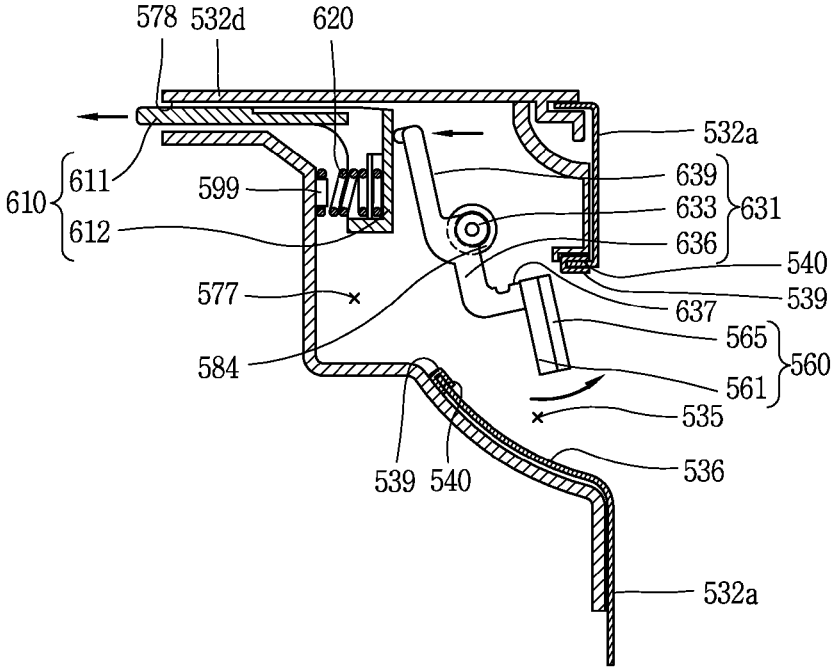
FIG. 24 is a view showing an operation when a door handle of the door of FIG. 23 is pulled.

When the slider 610 and the driving force transfer unit 630 are completely coupled to each receiving space 577, as shown in FIG. 23, the handle main body 561 may be inserted into the handle coupling part 535. Each end of the handle main body 561 may be coupled to the handle mounting portion 637 of each linker body part 636 by means of the coupling member 564, and the handle cover 565 may be coupled to the handle main body 561. In the meantime, to open the freezing chamber 521, as shown in FIG. 24, when the door handle 560 is pulled forward, the linker 631 may revolve around the linker axis 633.

In response to the door handle 560 being pulled forward, the linker body part 636 may be rotated toward the front door handle 560 and the linker head part 639 may be rotated toward the rear slider 610. As the linker head part 639 is rotated, the slider 610 may be pressed backwardly so as to protrude from the door main body 531. The end of the slider 610 protruded from the door main body 531 may contact and press the edge of the front opening f the freezing chamber 521, accordingly, the door main body 531 may be easily open from the refrigerator main body 510.

As described above, in accordance with one exemplary embodiment of the present disclosure, a door handle, a slider and a driving force transfer unit may be detachable through receiving parts, so as to be drawn out of and/or reattached into a door main body. This structure may not require an opening for detaching and attaching the driving force transfer unit on an outside of the door main body, allowing the driving force transfer unit to be easily detached and inspected without ruining the appearance of the door main body.

The slider may be configured to be detachable by pulled in a protruding direction, simplifying the configuration of the driving force transfer unit and further facilitating for attachment and detachment of the driving force transfer unit. A buffer may be placed on a contact area between a case of the driving force transfer unit and a lever, thereby preventing damage of components and generation of noise, caused due to an impact between the case and the lever upon operating the door handle.

A receiving part for receiving the driving force transfer unit may be provided with a supporting protrusion and the case may be provided with a contact protrusion, to cope with an external force when the door handle is pulled, thereby reducing the number of screws of the driving force transfer unit. This may further facilitate for the attachment and detachment of the driving force transfer unit. In addition, a penetrating portion for insertion of the driving force transfer unit may be formed through an outer case of the door to be located at the rear of the door handle. Accordingly, the penetrating portion may be visually veiled by the door handle, thereby improving the quality of the appearance.

With placing within a handle coupling part a slider protruding from the door main body, a linker connected to the door handle to transfer a driving force to the slider, and a second linker axis supporter to support a second linker axis of the linker, the configuration may be simplified and fabrication and assembly may be facilitated. As a first linker axis supporting part to support a first linker axis is placed in the pocket housing, the number of components may be reduced and an assembly operation may become easier.

The pocket housing may be provided with a second linker axis supporter coupling part to which the second liner axis supporter is coupled and the second linker axis supporter coupling part may be provided with a rotation preventing part to prevent rotation of the second linker axis supporter. This may allow for reduction of coupling screws, resulting in reducing the number of components and shortening a time taken for detachment and/or attachment of such components. As the slider is provided with an elastic part fastening part to fix one end of an elastic part, attachment and/or detachment of the elastic part may be facilitated.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims

What is claimed is:

1. A refrigerator comprising:

a refrigerator main body having a storage compartment; and a door to open and close the compartment, wherein the door comprises:

a door main body;

a door handle movably disposed on the door main body to actuate the door main body to be easily open;

a slider protruding toward the refrigerator main body in response to movement of the door handle;

a driving force transfer unit located between the door handle and the slider to transfer a driving force, generated upon pulling the door handle, to the slider; and a pocket housing buried in the door main body and having a receiving part to receive the driving force transfer unit, the slider and the door handle therein, wherein the slider and the driving force transfer unit are capable of being individually detachable from each other, wherein the door main body comprises an outer plate having a handle coupling part, wherein the handle coupling part comprises a recess portion recessed into a front of the outer plate to protrude to a rear of the outer plate and a penetrating portion formed through a plate surface of the outer plate, wherein the penetrating portion defines a plane for the handle coupling part and the handle crosses the plane, wherein the slider is detached from the door main body by being outwardly pulled with a predetermined force, wherein the driving force transfer unit comprises:

a case detachably received in the pocket housing and having a cavity with inner walls; and a linker located inside the cavity, the linker having a body part and a first linker axis and a second linker axis to rotatably support the body part, wherein the body part comprises one end portion connected to the door handle, and a head part movable in an opposite direction to the one end portion when the linker revolves, wherein the head part of the linker comprises a first coupling part which is slidable, and wherein the slider comprises a second coupling part detachably coupled to the first coupling part.

2. The refrigerator of claim 1, wherein the case comprises:

a first linker axis supporting part formed on a first side wall of the cavity to support the first linker axis;

a second linker axis supporting part formed on a second side wall of the cavity to support the second linker shaft; and a guide way to guide the first coupling part of the head part of the linker to be movable horizontally.

3. The refrigerator of claim 2, wherein the case has a coupling member inserted into the first linker axis and the second linker axis through the first linker axis supporting part and the second linker axis supporting part.

4. The refrigerator of claim 1, wherein the pocket housing has a sliding way having an open end toward the refrigerator main body, the open end allowing the slider to be attachable and detachable therethrough.

5. The refrigerator of claim 4, wherein the slider has a head part bigger in width than the open end of the sliding way to limit sliding distance toward the inside of the door.

6. The refrigerator of claim 1, wherein an elastic part is associated with an inner wall of the pocket housing and the slider so that the slider is able to be back into an initial position thereof.

7. The refrigerator of claim 6, wherein one end of the elastic part directly contacts the body part of the slider.

8. The refrigerator of claim 6, wherein one end of the elastic part contacts the linker coupled with the slider.

9. The refrigerator of claim 1, wherein the driving force transfer unit further comprises a lever located between the linker and the door handle so as to revolve the linker in response to the rotation of the door handle.

10. The refrigerator of claim 1, wherein a supporting protrusion is placed within the pocket housing to support the case not to be detached, and wherein a contact protrusion contactable with the supporting protrusion is placed in the case.

11. The refrigerator of claim 10, wherein the supporting protrusion and the contact protrusion are provided in plurality, respectively, the plurality of supporting protrusion and the plurality of contact protrusions being disposed with a gap such that a different protrusion is inserted through the gap.

12. The refrigerator of claim 1, wherein the pocket housing comprises a single receiving part communicating with the outside.

13. A refrigerator comprising:

a refrigerator main body having a storage compartment; and a door to open and close the compartment, wherein the door comprises:

a door main body;

a door handle movably disposed on the door main body to actuate the door main body to be easily open;

a slider protruding toward the refrigerator main body in response to movement of the door handle;

a driving force transfer unit located between the door handle and the slider to transfer a driving force, generated upon pulling the door handle, to the slider; and a pocket housing buried in the door main body and having a receiving part to receive the driving force transfer unit, the slider and the door handle therein, wherein the driving force transfer unit comprises:

a linker having a linker body part and a first linker axis and a second linker axis to rotatably support the linker body part;

a first linker axis supporting part formed in the pocket housing to support the first linker axis; and a second linker axis supporter detachably coupled to the pocket housing to support the second linker axis, wherein the door main body comprises an outer plate having a handle coupling part, wherein the handle coupling part comprises a recess portion recessed into a front of the outer plate to protrude to a rear of the outer plate and a penetrating portion formed through a plate surface of the outer plate, wherein the penetrating portion defines a plane for the handle coupling part and the handle crosses the plane, wherein the slider is drawn out through the penetrating portion after the second linker axis supporter is detached from the pocket housing, wherein the door main body comprises an outer case defining an appearance and an inner case disposed at an inner side of the outer case, and wherein the pocket housing comprises:

a receiving part exposed to outside of the outer case of the door and receiving therein at least one area of the door handle, the linker and the slider to be detachable to the outside; and a sliding guide part located between the outer case and the inner case of the door in the pocketing housing.

14. The refrigerator of claim 13, wherein the slider comprises:

a sliding part slidable horizontally;

a slider body part to support the sliding part; and an elastic part to allow the slider body part to come in contact with the linker, wherein the sliding part is located within the sliding guide part of the pocket housing.

15. The refrigerator of claim 13, wherein the second linker axis supporter comprises a body part, and wherein the body part comprises:

a fastening part to fix the second linker axis supporter to the pocket housing and selectively release the fixed second linker axis supporter from the pocket housing; and a second linker axis supporting part to receive and support the second linker axis.

16. The refrigerator of claim 13, wherein the pocket housing comprises a rotation preventing part coming in contact with an outer side of the second linker axis supporter to prevent rotation of the second linker axis supporter.

17. The refrigerator of claim 16, wherein the rotation preventing part comprises a lower supporting part protruding from the pocket housing to come in contact with a lower portion of the second linker axis supporter, or a side supporting part protruding from the pocket housing to come in contact with a side portion thereof.

18. The refrigerator of claim 16, wherein the rotation preventing part comprises:

a rib protruding from the pocket housing to be inserted into the second linker axis supporter; and a rib slit formed on the second linker axis supporter such that the rib is inserted therein.

19. The refrigerator of claim 15, wherein the fastening part is formed through the body part such that the coupling member coupled to the pocket housing through the body part is inserted therethrough.

20. A refrigerator comprising:

a refrigerator main body having a storage compartment; and a door to open and close the compartment, wherein the door comprises:

a door main body;

a door handle movably disposed on the door main body to actuate the door main body to be easily open;

a slider protruding toward the refrigerator main body in response to movement of the door handle;

a driving force transfer unit located between the door handle and the slider to transfer a driving force, generated upon pulling the door handle, to the slider; and a pocket housing buried in the door main body and having a receiving part to receive the driving force transfer unit, the slider and the door handle therein, wherein the slider and the driving force transfer unit are capable of being individually detachable from each other, wherein the door main body comprises an outer plate having a handle coupling part, wherein the handle coupling part comprises a recess portion recessed into a front of the outer plate to protrude to a rear of the outer plate and a penetrating portion formed through a plate surface of the outer plate, wherein the penetrating portion defines a plane for the handle coupling part and the handle crosses the plane, wherein the slider is detached from the door main body by being outwardly pulled with a predetermined force, and wherein an elastic part is associated with an inner wall of the pocket housing and the slider so that the slider is able to be back into an initial position thereof.

21. The refrigerator of claim 20, wherein one end of the elastic part directly contacts the body part of the slider.

22. The refrigerator of claim 20, wherein one end of the elastic part contacts the linker coupled with the slider.

* * * * *